US006367916B2

(12) United States Patent
Asano

(10) Patent No.: US 6,367,916 B2
(45) Date of Patent: Apr. 9, 2002

(54) PIEZOELECTRIC DEVICE FOR CONTROLLING INK EJECTION AND INKJET HEAD FOR INKJET PRINTER

(75) Inventor: Takeshi Asano, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/126,596

(22) Filed: Jul. 31, 1998

(30) Foreign Application Priority Data

Aug. 5, 1997 (JP) ..... 9-210823

(51) Int. Cl.[7] ..... B41J 2/045

(52) U.S. Cl. ..... 347/69; 347/68; 347/71; 347/72

(58) Field of Search ..... 347/68–72

(56) References Cited

U.S. PATENT DOCUMENTS 5,639,508 A * 6/1997 Okawa et al. ..... 347/72
6,174,051 B1 * 1/2001 Sakaida ..... 347/72

FOREIGN PATENT DOCUMENTS

JP A-10-58674 3/1998 ..... B41J/2/045
JP A-10-58675 3/1998 ..... B41J/2/045

* cited by examiner

*Primary Examiner*—John Barlow
*Assistant Examiner*—An H. Do
(74) *Attorney, Agent, or Firm*—Oliff & Berridge, PLC

(57) ABSTRACT

A piezoelectric device for applying pressure to ink within a plurality of ink chambers formed in an inkjet head to control ejection of the ink, the piezoelectric device being mounted on a plate body of the inkjet head on which the plurality of ink chambers and a plurality of peripheral portions are alternately arranged, the piezoelectric device having: a base piezoelectric layer whose underside is fixed onto the plate body, and covering over the ink chambers and the peripheral portions, the base piezoelectric layer being polarized in a direction of its thickness; an electric field applying device for applying an electric field to the base piezoelectric layer, a direction of the electric field intersecting a polarization direction of the base piezoelectric layer; and a plurality of piezoelectric members arranged on an upside of the base piezoelectric layer, and located at positions corresponding to the ink chambers respectively, each of the piezoelectric members having a plurality of piezoelectric layers and a plurality of electrode layers, the piezoelectric layers and the electrode layers being alternately laminated, each of the piezoelectric layers being polarized in a direction of its thickness such that respective polarization directions of the piezoelectric layers are reversed for each of the piezoelectric layers.

19 Claims, 21 Drawing Sheets

PIEZOELECTRIC DEVICE FOR CONTROLLING INK EJECTION AND INKJET HEAD FOR INKJET PRINTER

BACKGROUND OF THE INVENTION

1. Field of Invention

The present invention relates generally to an inkjet head to be used for an inkjet type printer or the like, more specifically to an inkjet head having piezoelectric device to apply positive pressure or negative pressure to ink to control ink ejection.

2. Description of the Related Art

FIG. 1 shows the configuration of a conventional inkjet head. In such an inkjet head, an ink passage 103 and a plurality of ink chambers 105 (one of which is depicted) are formed on a plate portion 104. Ink is supplied from the ink passage 103 to the ink chambers 105, and then, a piezoelectric element 101 applies pressure to the ink, so that the ink is ejected through an ink nozzle 102.

The ink ejecting action of the inkjet head is further explained with reference to FIG. 2. FIG. 2 is a sectional view taken substantially along the line II—II of FIG. 1. As shown in FIG. 2, electrodes 106 to be negatively charged and electrodes 107 to be positively charged are mounted on the piezoelectric element 101. These electrodes 106 and 107 are located at positions corresponding to the ink chambers 105, respectively. By using the electrodes 106 and 107, an electric field whose direction is perpendicular to the polarization direction of the piezoelectric element 101 is applied to the piezoelectric element 101 in order to distort the piezoelectric element 101 in a shear mode (thickness shear mode). Namely, when the electric field is applied, the piezoelectric element 101 deflects inwardly into the ink chambers 105, and pressure is applied to the ink within the ink chambers 105. In such a manner, the ink ejection can be realized. In addition, the shear mode means a mode of distortion that occurs by applying an electric field whose direction is perpendicular to the polarization direction of a piezoelectric element.

Furthermore, an ink ejecting action of another inkjet head using the shear mode is explained with reference to FIG. 3. FIG. 3 is a sectional view of the inkjet head. As shown in FIG. 3, electrodes 202 to be positively charged and electrodes 203 to be negatively charged are mounted on a piezoelectric element 201. The electrodes 202 are located at positions corresponding to ink chambers 205 formed on a plate portion 204, respectively. The electrodes 203 are located at positions corresponding to side wall portions, respectively. By using the electrodes 202 and 203, an electric field whose direction is perpendicular to the polarization direction of the piezoelectric element 201 is applied to the piezoelectric element 201 in order to distort the piezoelectric element 201 in the shear mode. Thus, it is possible to apply pressure to ink within the ink chambers 205 to eject the ink.

Moreover, an ink ejecting action of an inkjet head using a distortion mode other than the shear mode is explained with reference to FIG. 4. FIG. 4 is a sectional view of the inkjet head. As shown in FIG. 4, a diaphragm 303 is disposed on ink chambers 304 formed on a plate portion 305 as an upper wall. Laminated piezoelectric members are mounted on the surface of the diaphragm 303. Each of the laminated piezoelectric members is formed of a plurality of piezoelectric elements 301 and a plurality of electrode layers 302. The piezoelectric elements 301 and the electrode layers 302 are alternately laminated. By using the electrode layers 302, an electric field whose direction is parallel to the polarization direction of the piezoelectric elements 301 is applied to the piezoelectric elements 301 in order to distort the piezoelectric elements 301 in an expansion mode (longitudinal vibration mode). Thus, it is possible to apply pressure to ink within the ink chambers 304 to eject the ink. In addition, the expansion mode means a mode of distortion that occurs by applying an electric field whose direction is parallel to the polarization direction of a piezoelectric element.

However, in the inkjet head using the shear mode shown in FIG. 2 or FIG. 3, distortion of the piezoelectric element 101 or 201 is relatively small. Therefore, it is required to apply a high voltage to the piezoelectric element 101 or 201 in order to obtain sufficient distortion to realize optimum ink ejection.

On the other hand, in the inkjet head using the expansion mode shown in FIG. 4, distortion of the each laminated piezoelectric member is relatively large. Therefore, sufficient distortion can be obtained by a low voltage. However, the diaphragm 303 is made of a soft elastic material so as not to restrict distortion of each piezoelectric element 301. Therefore, pressure which has been applied to ink within the ink chambers 304 is reduced due to the soft elasticity of the diaphragm 303.

Furthermore, in the inkjet head using the expansion mode shown in FIG. 4, the plate portion 305, the diaphragm 303, the piezoelectric elements 301, and so on are separated as independent parts, respectively. When assembling the inkjet head, these parts are accurately bonded to each other at the predetermined positions by using adhesive. Therefore, if the size of an inkjet head is reduced, the manufacture of the inkjet head is difficult.

SUMMARY OF THE INVENTION

It is therefore a first object of the present invention to provide a piezoelectric device which can be distorted largely and dynamically by low electric energy to thereby control ink ejection efficiently.

It is a second object of the present invention to provide a piezoelectric device which can be simplified its construction and its manufacturing process, providing large and dynamic distortion by low electric energy.

It is a third object of the present invention to provide an inkjet head which can be simplified its construction and its manufacturing process, improving ink ejection performance.

According to the present invention, the above mentioned objects can be achieved by a piezoelectric device for applying pressure to ink within a plurality of ink chambers formed in an inkjet head to control ejection of the ink, the piezoelectric device being mounted on a plate body of the inkjet head on which the plurality of ink chambers and a plurality of peripheral portions are alternately arranged, the piezoelectric device having: a base piezoelectric layer whose underside is fixed onto the plate body, and covering over the ink chambers and the peripheral portions, the base piezoelectric layer being polarized in a direction of its thickness; an electric field applying device for applying an electric field to the base piezoelectric layer, a direction of the electric field intersecting a polarization direction of the base piezoelectric layer; and a plurality of piezoelectric members arranged on an upside of the base piezoelectric layer, and located at positions corresponding to the ink chambers respectively. Each of the piezoelectric members has a plurality of piezoelectric layers and a plurality of electrode layers. The piezoelectric layers and the electrode layers are alternately laminated. Each of the piezoelectric layers is polarized in a direction of its thickness such that respective polarization directions of the piezoelectric layers are reversed for each of the piezoelectric layers.

In this piezoelectric device, when voltages having certain polarities are supplied to the electric field applying device, the electric field applying device generates an electric field whose direction intersects the polarization direction of the base piezoelectric layer, and applies the electric field to the base piezoelectric layer. Therefore, the base piezoelectric layer is distorted in a shear mode. As a result, the base piezoelectric layer protrudes to the inside of the ink chambers.

Furthermore, when voltages having a certain polarities are supplied to the respective electrode layers of each piezoelectric member, the electric field whose direction is parallel to the polarization direction of each of the piezoelectric layers of the piezoelectric member is generated, and applied to each of the piezoelectric layers. Therefore, each of the piezoelectric layers is distorted in an expansion mode, and the piezoelectric member as a whole expands toward the base piezoelectric layer. As a result, the piezoelectric member pushes the base piezoelectric layer, and base piezoelectric layer protrudes to the inside of the ink chambers.

Thus, the base piezoelectric layer is distorted largely and dynamically by the cooperation of the shear mode distortion and the expansion mode distortion, and therefore, pressure is applied to ink within each ink chamber to thereby eject the ink.

Consequently, it is possible to obtain large and dynamic distortion of the base piezoelectric layer efficiently. Especially, the piezoelectric member expands by applying a low voltage, and pushes the base piezoelectric layer toward the inside of each ink chamber. At this time, the base piezoelectric layer itself is distorted in the shear mode. Thus, it is possible to obtain large and dynamic distortion of the base piezoelectric layer by a low voltage, and it is possible to improve the ink ejecting performance of the inkjet head, reducing electric power consumption.

Furthermore, the base piezoelectric layer covers over the respective ink chambers. Namely, the base piezoelectric layer serves as an upper wall of each ink chamber. Since the base piezoelectric layer has relatively high stiffness, it is possible to prevent the pressure that has been applied to the ink within the ink chamber from reducing.

Moreover, the electric field applying device may have a plurality of first electrodes and a plurality of second electrodes mounted on the upside or underside of the base piezoelectric layer. The first electrodes may be located at positions corresponding to the ink chambers respectively, and the second electrodes may be located at positions corresponding to the peripheral portions respectively. Thus, the electric field whose direction intersects the polarization direction of the base piezoelectric layer can be applied to the base piezoelectric layer.

According to the present invention, the above mentioned objects can be also achieved by a piezoelectric device for applying pressure to ink within a plurality of ink chambers formed in an inkjet head to control ejection of the ink, the piezoelectric device being mounted on a plate body of the inkjet head on which the plurality of ink chambers and a plurality of peripheral portions are alternately arranged, the piezoelectric device having: an elastic layer whose underside is fixed onto the plate body, and covering over the ink chambers and the peripheral portions, the elastic layer being made of an elastic material; a base piezoelectric layer laminated on an upside of the elastic layer, the base piezoelectric layer being polarized in a direction of its thickness; a first electric field applying device for applying a first electric field to the base piezoelectric layer, a direction of the first electric field being parallel to a polarization direction of the base piezoelectric layer; and a plurality of piezoelectric members arranged on an upside of the base piezoelectric layer, and located at positions corresponding to the ink chambers respectively. Each of the piezoelectric members has a plurality of piezoelectric layers and a plurality of electrode layers. The piezoelectric layers and the electrode layers are alternately laminated. Each of the piezoelectric layers is polarized in a direction of its thickness such that respective polarization directions of the piezoelectric layers are reversed for each of the piezoelectric layers.

In this piezoelectric device, when voltages having certain polarities are supplied to the first electric field applying device, the first electric field applying device generates a first electric field whose direction is parallel to the polarization direction of the base piezoelectric layer, and applies the first electric field to the base piezoelectric layer. At this time, since the base piezoelectric layer is laminated on the elastic layer, the underside of the base piezoelectric layer is fixed onto the upside of the elastic layer. Therefore, the shrinkage of the underside of the base piezoelectric layer is restricted. Accordingly, the piezoelectric layer is distorted in a unimorph mode.

Furthermore, when voltages having a certain polarities are supplied to the respective electrode layers of each piezoelectric member, the first electric field whose direction is parallel to the polarization direction of each of the piezoelectric layers of the piezoelectric member is generated, and applied to each of the piezoelectric layers. Therefore, each of the piezoelectric layers is distorted in the expansion mode, and the piezoelectric member as a whole expands toward the base piezoelectric layer. As a result, the piezoelectric member pushes the base piezoelectric layer, and the elastic layer protrudes to the inside of the ink chambers by the distortion of the base piezoelectric layer.

Thus, the base piezoelectric layer is distorted largely and dynamically by the cooperation of the unimorph mode distortion and the expansion mode distortion, and therefore, pressure is applied to ink within each ink chamber to thereby eject the ink.

Consequently, it is possible to obtain large and dynamic distortion of the base piezoelectric layer efficiently. Especially, the piezoelectric member expands by applying a low voltage, and pushes the base piezoelectric layer toward the inside of each ink chamber. At this time, the base piezoelectric layer itself is distorted in the unimorph mode. Thus, it is possible to obtain large and dynamic distortion of the base piezoelectric layer by a low voltage, and it is possible to improve the ink ejecting performance of the inkjet head, reducing electric power consumption.

Furthermore, the first electric field applying device may have a plurality of first electrodes mounted between the elastic layer and the base piezoelectric layer. The first electric field can be applied to the base piezoelectric layer by using each of the first electrodes and one of the electrode layers included in each piezoelectric member. Namely, the electrode layer, which is included in the piezoelectric member and located at the closest position to the base piezoelectric layer, works for applying the first electric field to the base piezoelectric layer, together with the first electrode. This electrode layer and the first electrode are opposite to each other across the base piezoelectric layer. Therefore, the first electric field whose direction is parallel to the polarization direction of the base piezoelectric layer can be applied to the base piezoelectric layer.

Moreover, the piezoelectric device may have a second electric field applying device for applying a second electric field, whose direction intersects the polarization direction of the base piezoelectric layer, to the base piezoelectric layer. Therefore, it is possible to distort the base piezoelectric layer in the shear mode. Thus, the base piezoelectric layer can be distorted largely and dynamically by the cooperation of the unimorph mode distortion, the expansion mode distortion, and the shear mode distortion. Consequently, it is possible to obtain large and dynamic distortion of the base piezoelectric layer efficiently.

Moreover, the second electric field applying device may have a plurality of first electrodes and a plurality of second electrodes mounted between the elastic layer and the base piezoelectric layer. The first electrodes may be located at positions corresponding to the ink chambers respectively, and the second electrodes may be located at positions corresponding to the peripheral portions respectively. Thus, the second electric field whose direction intersects the polarization direction of the base piezoelectric layer can be applied to the base piezoelectric layer.

According to the present invention, the above mentioned objects can be achieved by a piezoelectric device for applying pressure to ink within a plurality of ink chambers formed in an inkjet head to control ejection of the ink, the piezoelectric device being mounted on a plate body of the inkjet head on which the plurality of ink chambers and a plurality of peripheral portions are alternately arranged, the piezoelectric device having: a first base piezoelectric layer whose underside is fixed onto the plate body, and covering over the ink chambers and the peripheral portions, the first base piezoelectric layer being polarized in a direction of its thickness; a second base piezoelectric layer laminated on an upside of the first base piezoelectric layer, the second base piezoelectric layer being polarized in a direction of its thickness; a first electric field applying device for applying a first electric field to each of the first base piezoelectric layer and the second base piezoelectric layer, a direction of the first electric field being parallel to a polarization direction of each of the first base piezoelectric layer and the second base piezoelectric layer; and a plurality of piezoelectric members arranged on an upside of the second base piezoelectric layer, and located at positions corresponding to the ink chambers respectively. Each of the piezoelectric members has a plurality of piezoelectric layers and a plurality of electrode layers. The piezoelectric layers and the electrode layers are alternately laminated, each of the piezoelectric layers is polarized in a direction of its thickness such that respective polarization directions of the piezoelectric layers are reversed for each of the piezoelectric layers.

In this piezoelectric device, when voltages having certain polarities are supplied to the first electric field applying device, the first electric field applying device generates a first electric field whose direction is parallel to the polarization direction of each of the first base piezoelectric layer and the second base piezoelectric layer, and applies the first electric field to each of the first base piezoelectric layer and the second base piezoelectric layer. At this time, since the second base piezoelectric layer is laminated on the first base piezoelectric layer, the underside of the second base piezoelectric layer is fixed onto the upside of the first base piezoelectric layer. Therefore, both the first base piezoelectric layer and the second base piezoelectric layer are distorted in a bimorph mode.

Furthermore, when voltages having a certain polarities are supplied to the respective electrode layers of each piezoelectric member, the electric field whose direction is parallel to the polarization direction of each of the piezoelectric layers of the piezoelectric member is generated, and applied to each of the piezoelectric layers. Therefore, each of the piezoelectric layers is distorted in the expansion mode, and the piezoelectric member as a whole expands toward the first base piezoelectric layer and the second base piezoelectric layer. As a result, the piezoelectric member pushes the first base piezoelectric layer and the second base piezoelectric layer, and the first base piezoelectric layer protrudes to the inside of the ink chambers.

Thus, the first base piezoelectric layer is distorted largely and dynamically by the cooperation of the bimorph mode distortion and the expansion mode distortion, and therefore, pressure is applied to ink within each ink chamber to thereby eject the ink.

Consequently, it is possible to obtain large and dynamic distortion of the first base piezoelectric layer efficiently. Especially, the piezoelectric member expands by applying a low voltage, and pushes the first base piezoelectric layer and the second base piezoelectric layer toward the inside of each ink chamber. At this time, the first base piezoelectric layer and the second base piezoelectric layer are distorted in the bimorph mode. Thus, it is possible to obtain large and dynamic distortion of the first base piezoelectric layer by a low voltage, and it is possible to improve the ink ejecting performance of the inkjet head, reducing electric power consumption.

Furthermore, the first base piezoelectric layer covers over the respective ink chambers. Namely, the first base piezoelectric layer serves as an upper wall of each ink chamber. Since the first base piezoelectric layer has relatively high stiffness, it is possible to prevent the pressure that has been applied to the ink within the ink chamber from reducing.

Moreover, the first electric field applying device may have: a plurality of first electrodes mounted between the first base piezoelectric layer and the second base piezoelectric layer, and located at positions corresponding to the ink chambers respectively; and a second electrode mounted on the underside of the first base piezoelectric layer, and spreads over the underside of the first base piezoelectric layer.

In this first electric field applying device, the first electric field can be applied to the second base piezoelectric layer by using each of the first electrodes and one of the electrode layers included in each piezoelectric member. Namely, the electrode layer, which is included in the piezoelectric member and located at the closest position to the second base piezoelectric layer, works for applying the first electric field to the second base piezoelectric layer, together with the first electrode. This electrode layer and the first electrode are opposite to each other across the second base piezoelectric layer. Therefore, the first electric field whose direction is parallel to the polarization direction of the second base piezoelectric layer can be applied to the second base piezoelectric layer. Furthermore, the first electric field can be also applied to the first base piezoelectric layer by using each of the first electrodes and the second electrode. The first electrode is located at the position corresponding to the ink chamber. The second electrode spreads over the ink chamber. Namely, the first electrode and the second electrode are opposite to each other across the first base piezoelectric layer. Therefore, the first electric field whose direction is parallel to the polarization direction of the first base piezoelectric layer can be applied to the first base piezoelectric layer.

Alternatively, the first electric field applying device may have: a first electrode mounted between the first base piezoelectric layer and the second base piezoelectric layer, and spreads between the first base piezoelectric layer and the second base piezoelectric layer; and a plurality of second electrodes mounted on the underside of the first base piezoelectric layer, and located at positions corresponding to the ink chambers respectively. Also, in such a construction, the first electric field whose direction is parallel to the polarization direction of each of the first base piezoelectric layer and the second base piezoelectric layer can be applied to each of the first base piezoelectric layer and the second base piezoelectric layer.

Moreover, the piezoelectric device may have: a second electric field applying device for applying a second electric field, whose direction intersects the polarization direction of each of the first base piezoelectric layer and the second base piezoelectric layer, to each of the first base piezoelectric layer and the second base piezoelectric layer. Therefore, it is possible to distort each of the first base piezoelectric layer and the second base piezoelectric layer in the shear mode. Thus, the first base piezoelectric layer can be distorted largely and dynamically by the cooperation of the bimorph mode distortion, the expansion mode distortion, and the shear mode distortion. Consequently, it is possible to obtain large and dynamic distortion of the first base piezoelectric layer efficiently.

Moreover, the second electric field applying device may have a plurality of first electrodes and a plurality of second electrodes mounted between the first base piezoelectric layer and the second base piezoelectric layer. The first electrodes may be located at positions corresponding to the ink chambers respectively. The second electrodes may be located at positions corresponding to the peripheral portions respectively. Therefore, it is possible to apply the second electric field, whose direction intersects the polarization direction of each of first base piezoelectric layer and the second base piezoelectric layer, to each of first base piezoelectric layer and the second base piezoelectric layer.

According to the present invention, the above mentioned objects can be achieved by a piezoelectric device for applying pressure to ink within a plurality of ink chambers formed in an inkjet head to control ejection of the ink, the piezoelectric device being mounted on a plate body of the inkjet head on which the plurality of ink chambers and a plurality of peripheral portions are alternately arranged, the piezoelectric device having: a first base piezoelectric layer whose underside is fixed onto the plate body, and covering over the ink chambers and the peripheral portions, the first base piezoelectric layer being polarized in a direction of its thickness; a second base piezoelectric layer laminated on an upside of the first base piezoelectric layer, the second base piezoelectric layer being polarized in a direction of its thickness; a first electric field applying device for applying a first electric field to each of the first base piezoelectric layer and the second base piezoelectric layer, a direction of the first electric field intersecting a polarization direction of each of the first base piezoelectric layer and the second base piezoelectric layer; a second electric field applying device for applying a second electric field to the second base piezoelectric layer, a direction of the second electric field being parallel to a polarization direction of the second base piezoelectric layer; and a plurality of piezoelectric members arranged on an upside of the second base piezoelectric layer, and located at positions corresponding to the ink chambers respectively. Each of the piezoelectric members has a plurality of piezoelectric layers and a plurality of electrode layers. The piezoelectric layers and the electrode layers are alternately laminated. Each of the piezoelectric layers is polarized in a direction of its thickness such that respective polarization directions of the piezoelectric layers are reversed for each of the piezoelectric layers.

In this piezoelectric device, when voltages having certain polarities are supplied to the first electric field applying device, the first electric field applying device generates a first electric field whose direction intersects the polarization direction of each of the first base piezoelectric layer and the second base piezoelectric layer, and applies the first electric field to each of the first base piezoelectric layer and the second base piezoelectric layer. Therefore, each of the first base piezoelectric layer and the second base piezoelectric layer is distorted in the shear mode, respectively.

Furthermore, when voltages having certain polarities are supplied to the second electric field applying device, the second electric field applying device generates a second electric field whose direction is parallel to the polarization direction of the second base piezoelectric layer, and applies the second electric field to the second base piezoelectric layer. At this time, since the second base piezoelectric layer is laminated on the first base piezoelectric layer, the underside of the second base piezoelectric layer is fixed onto the upside of the first base piezoelectric layer. Therefore, the second base piezoelectric layer is distorted in the unimorph mode, together with the first base piezoelectric layer. In addition, an electric field whose direction is parallel to the polarization direction of the first base piezoelectric layer is not applied to the first base piezoelectric layer. Only the electric field whose direction intersects the polarization direction is applied to the first base piezoelectric layer.

Furthermore, when voltages having a certain polarities are supplied to the respective electrode layers of each piezoelectric member, the electric field whose direction is parallel to the polarization direction of each of the piezoelectric layers of the piezoelectric member is generated, and applied to each of the piezoelectric layers. Therefore, each of the piezoelectric layers is distorted in the expansion mode, and the piezoelectric member as a whole expands toward the first base piezoelectric layer and the second base piezoelectric layer. As a result, the piezoelectric member pushes the first base piezoelectric layer and the second base piezoelectric layer, and the first base piezoelectric layer protrudes to the inside of the ink chambers.

Thus, the first base piezoelectric layer is distorted largely and dynamically by the cooperation of the shear mode distortion, the unimorph mode distortion and the expansion mode distortion, and therefore, pressure is applied to ink within each ink chamber to thereby eject the ink.

Consequently, it is possible to obtain large and dynamic distortion of the first base piezoelectric layer efficiently. Especially, the piezoelectric member expands by applying a low voltage, and pushes the first base piezoelectric layer and the second base piezoelectric layer toward the inside of each ink chamber. At this time, the second base piezoelectric layer is distorted in the unimorph mode, together with the first base piezoelectric layer. Thus, it is possible to obtain large and dynamic distortion of the first base piezoelectric layer by a low voltage, and it is possible to improve the ink ejecting performance of the inkjet head, reducing electric power consumption.

Furthermore, the first base piezoelectric layer covers over the respective ink chambers. Namely, the first base piezoelectric layer serves as an upper wall of each ink chamber. Since the first base piezoelectric layer has relatively high stiffness, it is possible to prevent the pressure that has been applied to the ink within the ink chamber from reducing.

The inkjet head having the aforementioned piezoelectric device can be manufactured by the following processes. First, a plurality of electrodes are formed at predetermined positions on the upside of a base piezoelectric layer. Next, a plurality of piezoelectric layers are laminated on the upside of the base piezoelectric elements. At this time, an electrode has been formed on the upside of each of the piezoelectric layers. Next, the base piezoelectric layer and the laminated piezoelectric layers are sintered. Next, the base piezoelectric layer and the laminated piezoelectric layers are polarized, respectively. Next, a part of the laminated piezoelectric layers located at the position corresponding to each of peripheral portions is removed. Thus, the piezoelectric device is completed. Next, the underside of the base piezoelectric layer of the piezoelectric device is attached onto a plate body on which the ink chambers and peripheral portions have been alternately arranged. Next, a holding member is attached onto the top portion of the laminated piezoelectric layers of the piezoelectric device. In this manufacturing method, the inkjet head can be manufactured easily.

The inkjet head having the aforementioned piezoelectric device can be also manufactured by the following another processes. First, a plurality of electrodes are formed at predetermined positions on the upside of a base piezoelectric layer. Next, a plurality of piezoelectric members are formed at positions corresponding to the ink chambers on the upside of the base piezoelectric layer by laminating a plurality of piezoelectric layers on the upside of the base piezoelectric layer. At this time, each of the piezoelectric layers has a shape corresponding to an opening shape of each ink chamber, and an electrode has been formed on the upside of each of the piezoelectric layers. Next, the base piezoelectric layer and the laminated piezoelectric layers of the piezoelectric members are sintered. Next, the base piezoelectric layer and the laminated piezoelectric layers of the piezoelectric members are polarized, respectively. Thus, the piezoelectric device is completed. Next, the underside of the base piezoelectric layer of the piezoelectric device is attached onto a plate body on which the ink chambers and peripheral portions have been alternately arranged. Next, a holding member is attached onto the top portion of each of the piezoelectric members of the piezoelectric device. In this manufacturing method, the inkjet head can be manufactured easily.

The nature, utility, and further feature of this invention will be more clearly apparent from the following detailed description with respect to preferred embodiments of the invention when read in conjunction with the accompanying drawings briefly described below.

DETAILED DESCRIPTION OF PREFERRED EMBODIMENTS

Referring to the accompanying drawings, embodiments of the present invention will be now explained.

(I) Configuration of Inkjet Printer

Figure 1:
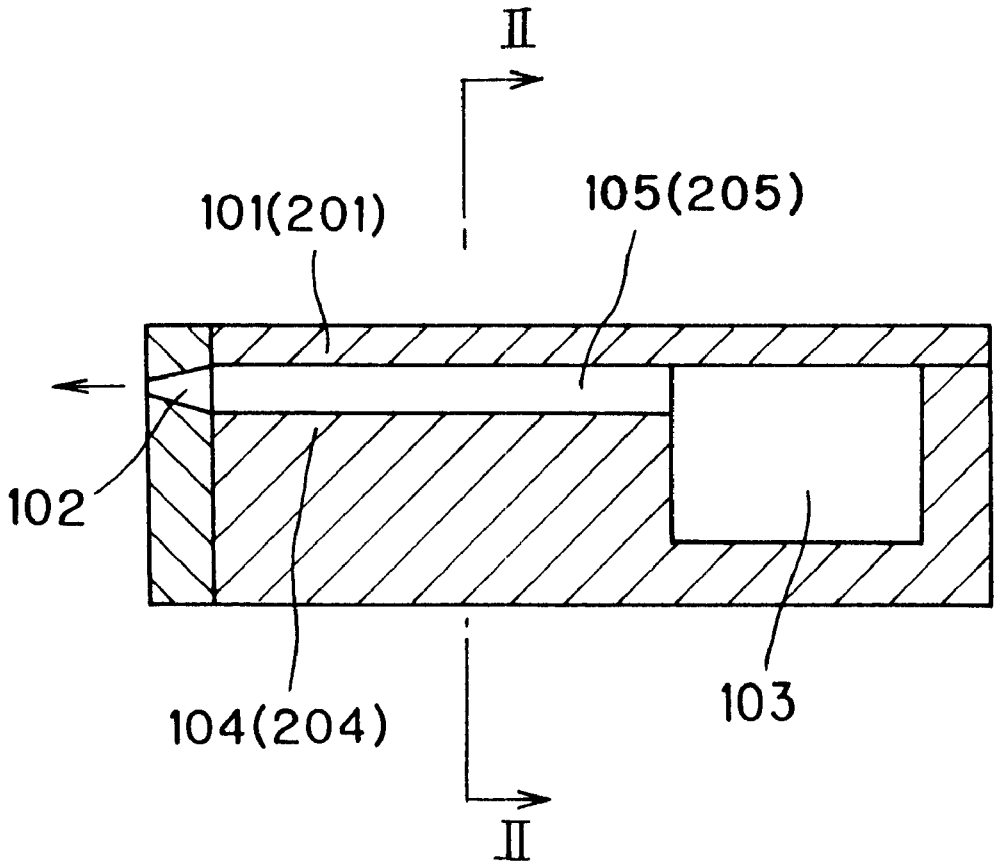
FIG. 1 (PRIOR ART)
FIG. 1 is a sectional view of a conventional inkjet head.
Figure 2:
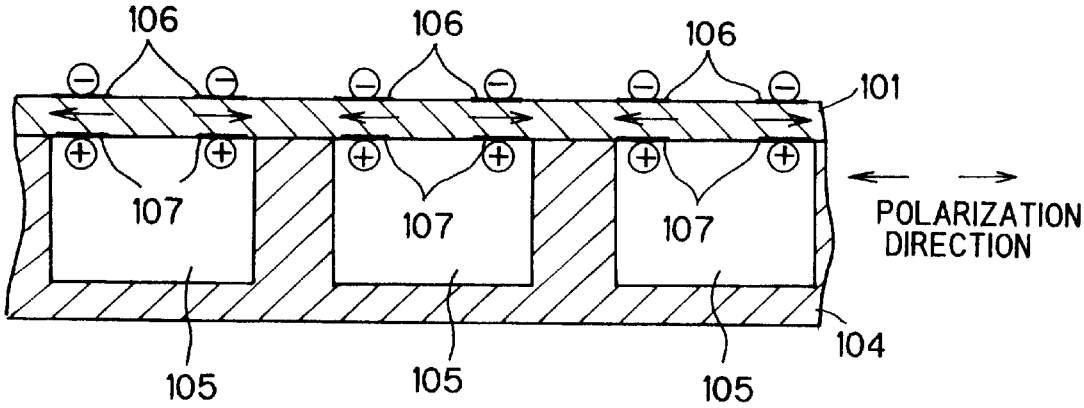
FIG. 2 (PRIOR ART)
FIG. 2 is a sectional view substantially taken along the line II—II of FIG. 1.
Figure 3:
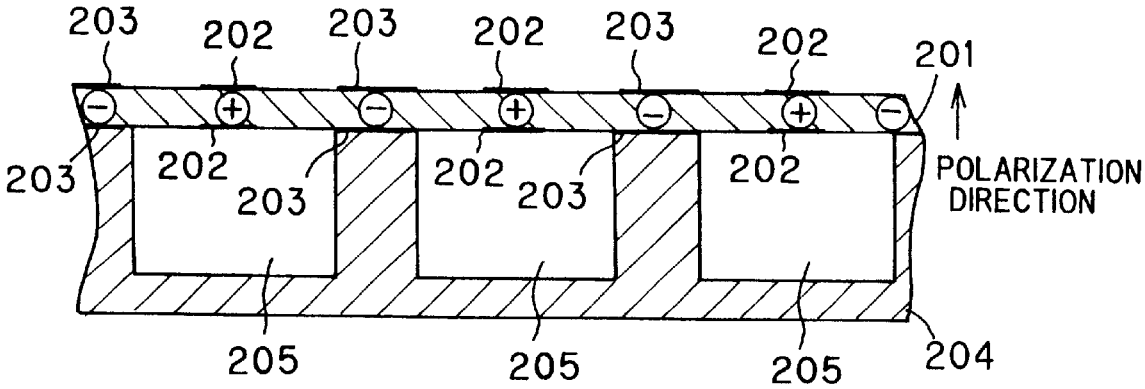
FIG. 3 (PRIOR ART)
FIG. 3 is a sectional view of another conventional inkjet head using a shear mode distortion.
Figure 4:
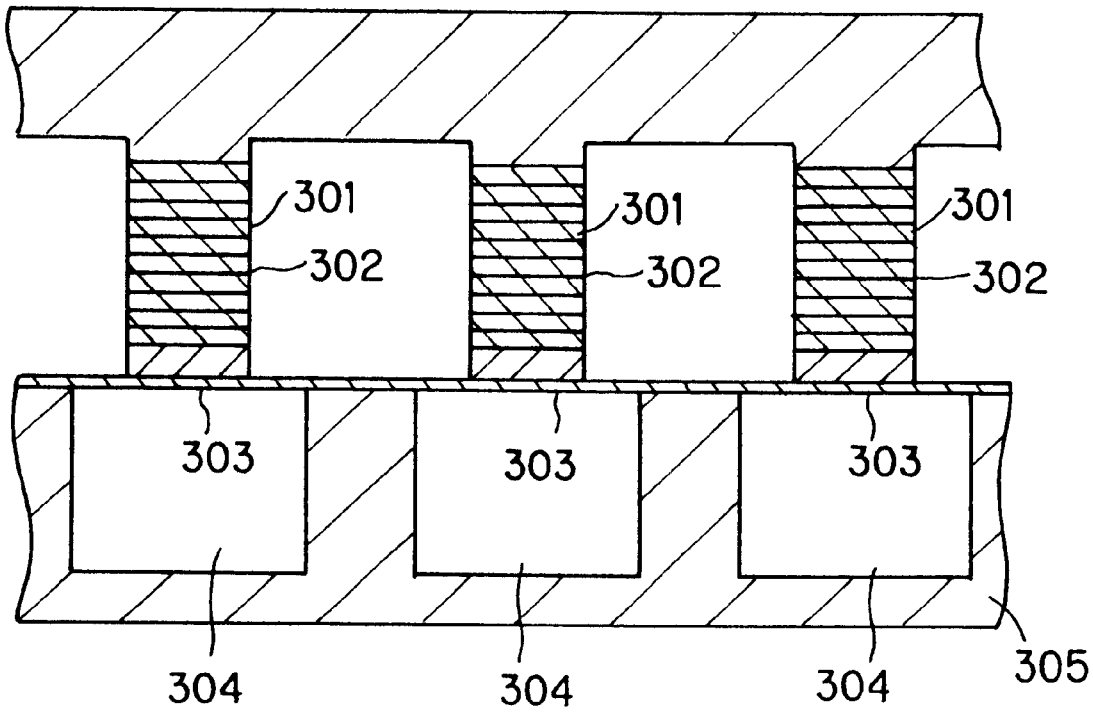
FIG. 4 (PRIOR ART)
FIG. 4 is a sectional view of a conventional inkjet head using an expansion mode distortion.
Figure 5:
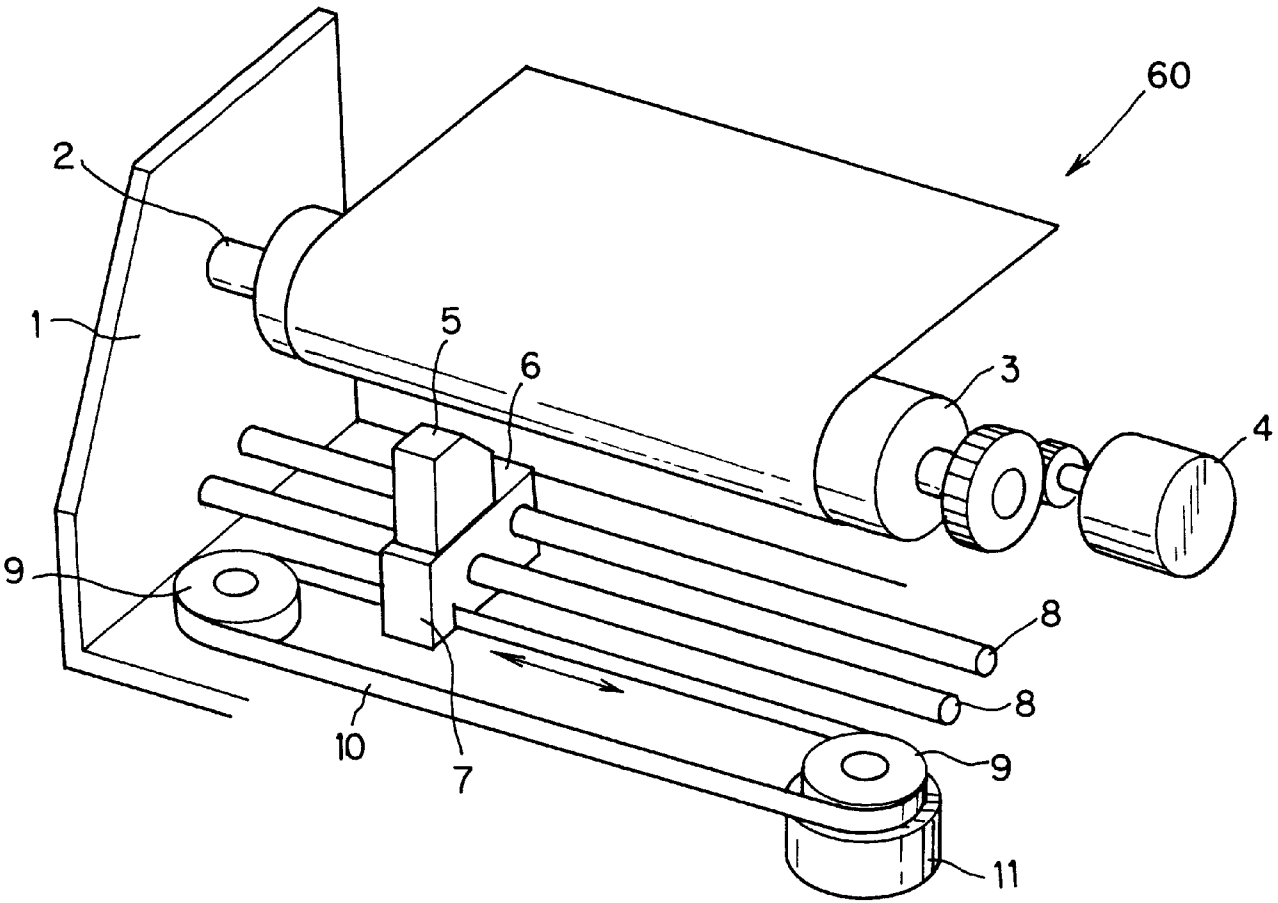
FIG. 5 is a perspective view showing schematically a driving section of an inkjet printer according to embodiments of the present invention.

FIG. 5 shows the configuration of a driving section in an inkjet printer 60. As shown in FIG. 5, the printer 60 has a body 1. In the body 1, a shaft 2 rotatably holds a platen 3 to send recording paper. The platen 3 is rotated by a motor 4. An inkjet head 5 of the present invention is disposed opposite to the platen 3. The inkjet head 5 is mounted on a carriage 7 together with an ink supplying device 6. Two guide rods 8 hold the carriage 7. Each of the guide rods 8 is arranged parallel to the shaft 2. A couple of pulleys 9 are mounted in the body 1 and a timing belt 10 is bridged between the pulleys 9. A part of the timing belt 10 is fixed to the carriage 7. Furthermore, one of the pulleys 9 is fixed to a shaft of the motor 11. When the pulley 9 is rotated by the motor 11, the carriage 7 moves together with the timing belt 10. Therefore, the inkjet head 5 is reciprocated along the platen 3.

In the printer 60 having the above mentioned construction, the platen 3 sends the recording paper. Synchronized with the motion of the platen 3, the carriage 7 moves along the platen 3. During these motion, the inkjet head 5 ejects ink to the recording paper to form an image on the recording paper.

(II) First Embodiment

Figure 6:
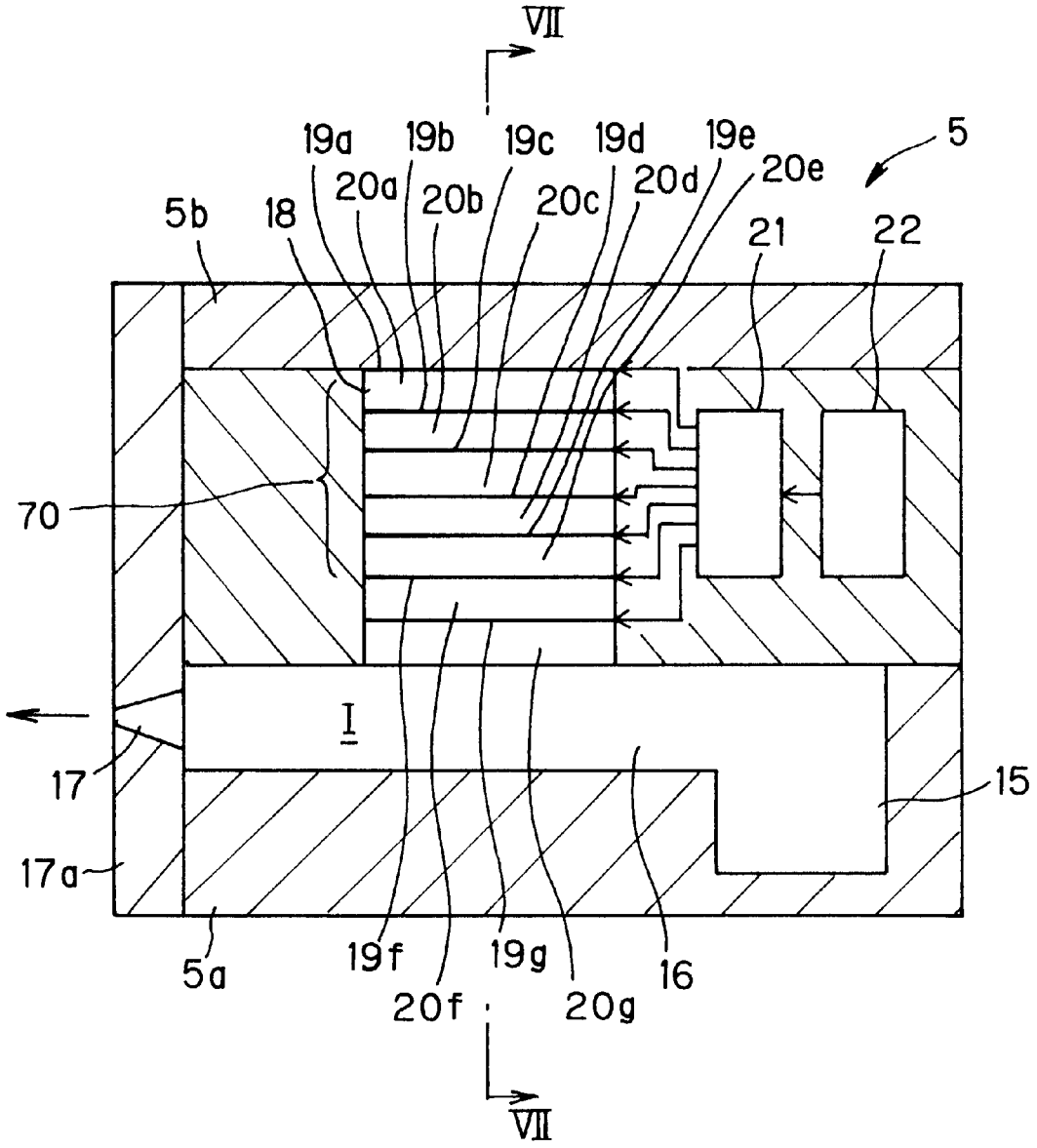
FIG. 6 is a sectional view of an inkjet head of a first embodiment of the present invention.
Figure 7:
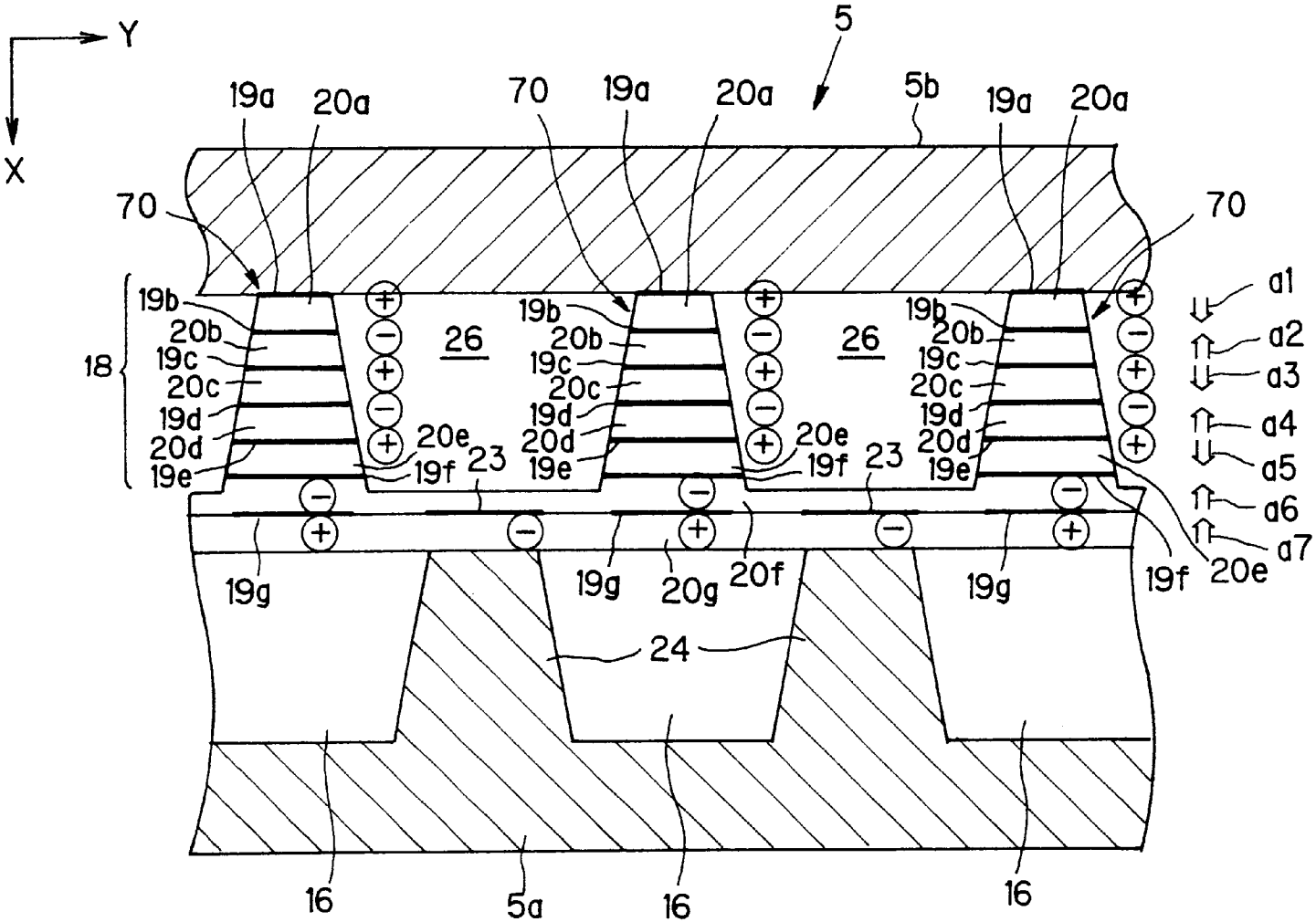
FIG. 7 is a sectional view substantially taken along the line VII—VII of FIG. 6.
Figure 8A:
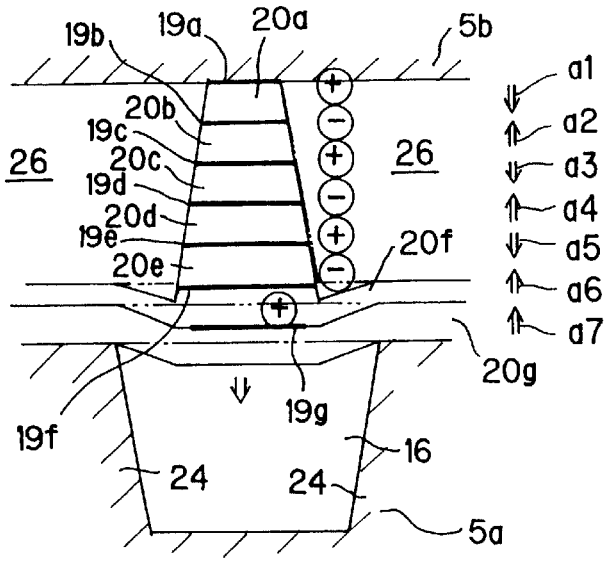
FIGS. 8A to 8C are sectional views each showing motion of a piezoelectric device of the inkjet head of the first embodiment.
Figure 8B:
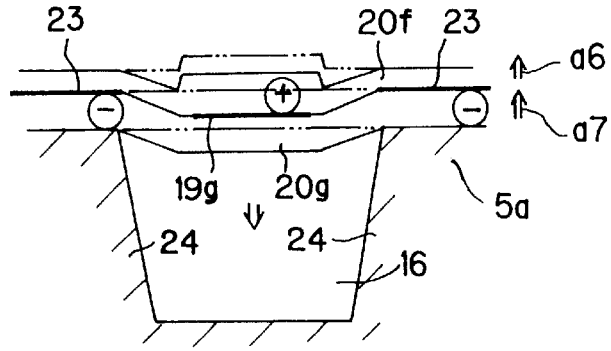
Figure 8C:
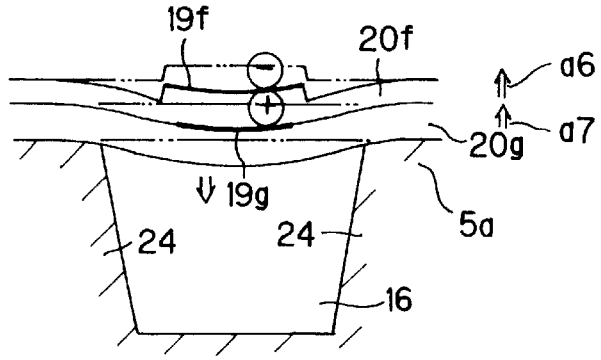

Referring to FIGS. 6 to 8C, an inkjet head of a first embodiment of the present invention is explained. FIG. 6 shows a section of the inkjet head 5 perpendicular to the length direction of the guide rods 8. FIG. 7 is a sectional view substantially taken along the line VII—VII of FIG. 6. FIGS. 8A to 8C show motions of a piezoelectric device installed in the inkjet head 5.

As shown in FIG. 6, the inkjet head 5 has a cavity plate 5*a,* a holding member 5*b,* a nozzle plate 17*a,* a piezoelectric device 18, a driving device 21 and a control device 22. The cavity plate 5*a* defines an ink passage 15 and a plurality of ink chambers 16 (One of which is depicted in FIG. 6.). The ink passage 15 temporarily stores ink supplied from the ink supplying device 6. The ink chambers 16 are arranged perpendicular to the surface of FIG. 6. The nozzle plate 17*a* is attached on the cavity plate 5*a* at the opposite side to the ink passage 15 and defines a plurality of ink ejection holes 17 (One of which is depicted.). The holding member 5*b* holds the top portion of the piezoelectric device 18. The driving device 21 drives the piezoelectric device 18 by applying voltages having certain polarities to electrodes or electrode layers formed in the piezoelectric device 18. The control device 22 controls the driving device 21 to control an ink ejecting action.

As shown in FIG. 7, the piezoelectric device 18 has a plurality of piezoelectric members 70, a couple of base piezoelectric layers 20*f* and 20*g,* a plurality of first electrode layers 19*g* and a plurality of second electrode layers 23. Each of the piezoelectric member 70 has a plurality of piezoelectric layers 20*a,* 20*b,* 20*c,* 20*d* and 20*e* and a plurality of electrode layers 19*a,* 19*b,* 19*c,* 19*d,* 19*e* and 19*f*. Each of the piezoelectric layers 20*a* to 20*g* is made of a piezoelectric material such as PZT (lead zirconate-lead titanate, $Pb(Zr, Ti)O_3$) or the like.

In operation, the driving device 21 independently applies voltages having certain polarities to the respective electrode layers 19*a* to 19*g* under the control of the control device 22. Therefore, each of piezoelectric layers 20*a* to 20*g* is distorted. As a result, pressure is applied to ink within the ink chambers 16 to thereby eject the ink from the ink ejection holes Next, the construction of the piezoelectric device 18 is explained in detail with reference to FIG. 7.

First, the base piezoelectric layers 20*f* and 20*g* are positioned near the cavity plate 5*a* as compared with the other piezoelectric layers 20*a* to 20*e*. As shown in FIG. 7, each of the base piezoelectric layers 20*f* and 20*g* is shaped in a sheet or a plate, and spreads over the respective ink chambers 16 and respective peripheral portions 24. In addition, the peripheral portion 24 is located between the ink chambers 16, and serves as a partition wall between the ink chambers 16. The underside of the base piezoelectric layer 20*g* is fixed onto the top portion of each of the peripheral portions 24. Furthermore, a plurality of electrode layers 19*g* and a plurality of electrode layers 23 are arranged between the base piezoelectric layers 20*f* and 20*g*. The electrode layers 19*g* are located at positions corresponding to the ink chambers 16, respectively. The electrode layers 23 are located at positions corresponding to the peripheral portions 24, respectively. Each of the electrode layers 19 and 23 extends along the ink chamber 16, namely, extends perpendicular to the surface of FIG. 7.

Next, as shown in FIG. 7, the piezoelectric members 70 are mounted on the upside of the base piezoelectric layer 20*f,* respectively. The piezoelectric members 70 are located at positions corresponding to the ink chambers 16, respectively. In the each of the piezoelectric members 70, the piezoelectric layers 20*a* to 20*e* and the electrode layers 19*a* to 19*f* are alternately laminated. The holding member 5*b* is fixed on the electrode layers 19*a*. Therefore, the top portions of the piezoelectric members 70 are held by the holding member 5*b*. Like the electrode layers 19*g* and 23, Each of the piezoelectric members 70 as a whole extends along the ink chamber 16, namely, extends perpendicular to the surface of FIG. 7. In addition, there are empty spaces 26 between the piezoelectric members 70.

Each of the piezoelectric layers 20*a* to 20*g* is polarized, as shown by arrows a1 to a7 in FIG. 7. When the piezoelectric device 18 is driven, voltages having certain polarities are applied to the respective electrode layers 19*a* to 19*g* and 23. In FIG. 7, the symbols "+" and "−" represent polarities of the voltages to apply to the respective electrode layers 19*a* to 19*g* and 23. Namely, a positive voltage is applied to each of the electrode layers 19*a,* 19*c,* 19*e* and 19*g*. A negative voltage is applied to each of the electrode layers 19*b,* 19*d,* 19*f* and 23.

Thus, by applying the voltages to each of the electrode layers 19*a* to 19*g,* the piezoelectric layers 20*a* to 20*f* are distorted in an expansion mode. As a result, the piezoelectric layers 20*a* to 20*f* as a whole expand toward the base piezoelectric layer 20*g,* and push the base piezoelectric layer 20*g* downwards, and therefore, the base piezoelectric layer 20*g* protrudes to the inside of the ink chambers 16. Furthermore, by applying the voltages to each of the electrode layers 19*g* and 23, the base piezoelectric layers 20*f* and 20*g* are distorted in a shear mode. As a result, the base piezoelectric layer 20*g* protrudes to the inside of the ink chambers 16. Moreover, by applying the voltages to each of the electrode layers 19*f* and 19*g,* the base piezoelectric layer 20*f* expands in the direction of its thickness (a Y direction in FIG. 7) and shrinks along its surface (an X direction in FIG. 7). At this time, since the base piezoelectric layer 20*g* functions as a restriction layer, the base piezoelectric layer 20*g* is distorted in a unimorph mode. As a result, the base piezoelectric layer 20*g* protrudes to the inside of the ink chambers 16.

Thus, the base piezoelectric layer 20*g* protrudes to the inside of the ink chamber 16 by the cooperation of the aforementioned three distortion modes of the piezoelectric layers 20*a* to 20*g*.

Each of the expansion mode, the shear mode and the unimorph mode is a distortion mode of a piezoelectric element. The expansion mode means a mode of distortion that occurs by applying an electric field whose direction is parallel to the polarization direction of a piezoelectric element. According to the expansion mode, the piezoelectric element expands in the parallel direction to its polarization direction.

The shear mode means a mode of distortion that occurs by applying an electric field whose direction intersects the polarization direction of a piezoelectric element. According to the shear mode, the piezoelectric element performs shearing deformation. In addition, it is preferable to apply an electric field whose direction is perpendicular to the polarization direction of a piezoelectric element, in order to obtain large distortion of the piezoelectric element in the shear mode.

The unimorph mode means a mode of distortion that occurs by applying an electric field whose direction is parallel to the polarization direction of a piezoelectric element, when one surface of the piezoelectric element perpendicular to the polarization direction is fixed to a plate which is made of an elastic material. Namely, when the electric field is applied, the piezoelectric element shrinks along its surface. At this time, since one surface is fixed to the plate, the shrinkage of this surface is restricted, so that the piezoelectric element as a whole curves.

Referring to FIGS. 8A to 8C, the distortion of each of the piezoelectric layers 20*a* to 20*g* in accordance with each distortion mode is explained in detail.

First, the distortion of each of the piezoelectric layer 20*a* to 20*f* in the expansion mode is explained. As shown in FIG. 8A, the direction of the electric field applied by each of the electrode layers 19*a* to 19*g* is parallel to the polarization direction of each of the piezoelectric layers 20*a* to 20*f*. Therefore, in FIG. 8A, each of the piezoelectric layers 20*a* to 20*f* expands in the longitudinal direction. Since the upward expansion is restricted by the holding member 5*b*, each of the piezoelectric layers 20*a* to 20*f* expands downwards. As a result, the base piezoelectric layer 20*g* protrudes to the inside of the ink chambers 16, so that pressure is applied to the ink within the ink chambers 16.

Next, the distortion of each of the base piezoelectric layers 20*f* and 20*g* in the shear mode is explained. As shown in FIG. 8B, the direction of the electric field applied by each of the electrode layers 19*g* and 23 is perpendicular to the polarization direction of each of the base piezoelectric layers 20*f* and 20*g*. Therefore, in FIG. 8B, each of the base piezoelectric layers 20*f* and 20*g* performs the shearing deformation in the longitudinal direction. As a result, the base piezoelectric layer 20*g* protrudes to the inside of the ink chambers 16, so that pressure is applied to the ink within the ink chambers 16.

Next, the distortion of the base piezoelectric layer 20*f* in the unimorph mode is explained. As shown in FIG. 8C, a positive voltage is applied to the underside of the base piezoelectric layer 20*f* by the electrode layers 19*g*, and a negative voltage is applied to the upside of the base piezoelectric layer 20*f* by the electrode layers 19*f*. Therefore, the base piezoelectric layer 20*f* expands in the direction of its thickness and shrinks along its surface. At this time, since the underside of the base piezoelectric layer 20*f* is fixed to the base piezoelectric layer 20*g*, the shrinkage of the underside of the base piezoelectric layer 20*f* is restricted. As a result, in FIG. 8C, both of the base piezoelectric layers 20*f* and 20*g* are distorted downwards, and the base piezoelectric layer 20*g* protrudes to the inside of the ink chambers 16, so that pressure is applied to the ink within the ink chambers 16.

Accordingly, by the cooperation of the distortions by three distortion modes, pressure to be applied to the ink within the ink chambers 16 is generated. By this pressure, the ink within the ink chambers 16 is ejected through the ink ejection holes 17.

As mentioned above, according to the inkjet head 5 of the present invention, the base piezoelectric layer 20*g* is distorted by the cooperation of the expansion mode, the shear mode and the unimorph mode. Therefore, it is possible to distort the base piezoelectric layer 20*g* largely and dynamically by a relatively low voltage.

Furthermore, according to the inkjet head 5 of the present invention, since the base piezoelectric layer 20*g* is used as the upper wall of the ink chambers 16, stiffness of the upper wall is increased as compared with a conventional inkjet head in which a diaphragm is used as an upper wall of ink chambers. Consequently, it is possible to prevent the pressure that has been applied to ink within the ink chambers 16 from reducing.

In addition, the base piezoelectric layer 20*g* can be made of an elastic material having an optimum stiffness similar to the piezoelectric material, instead of the piezoelectric material.

(III) Second Embodiment

Figure 9:
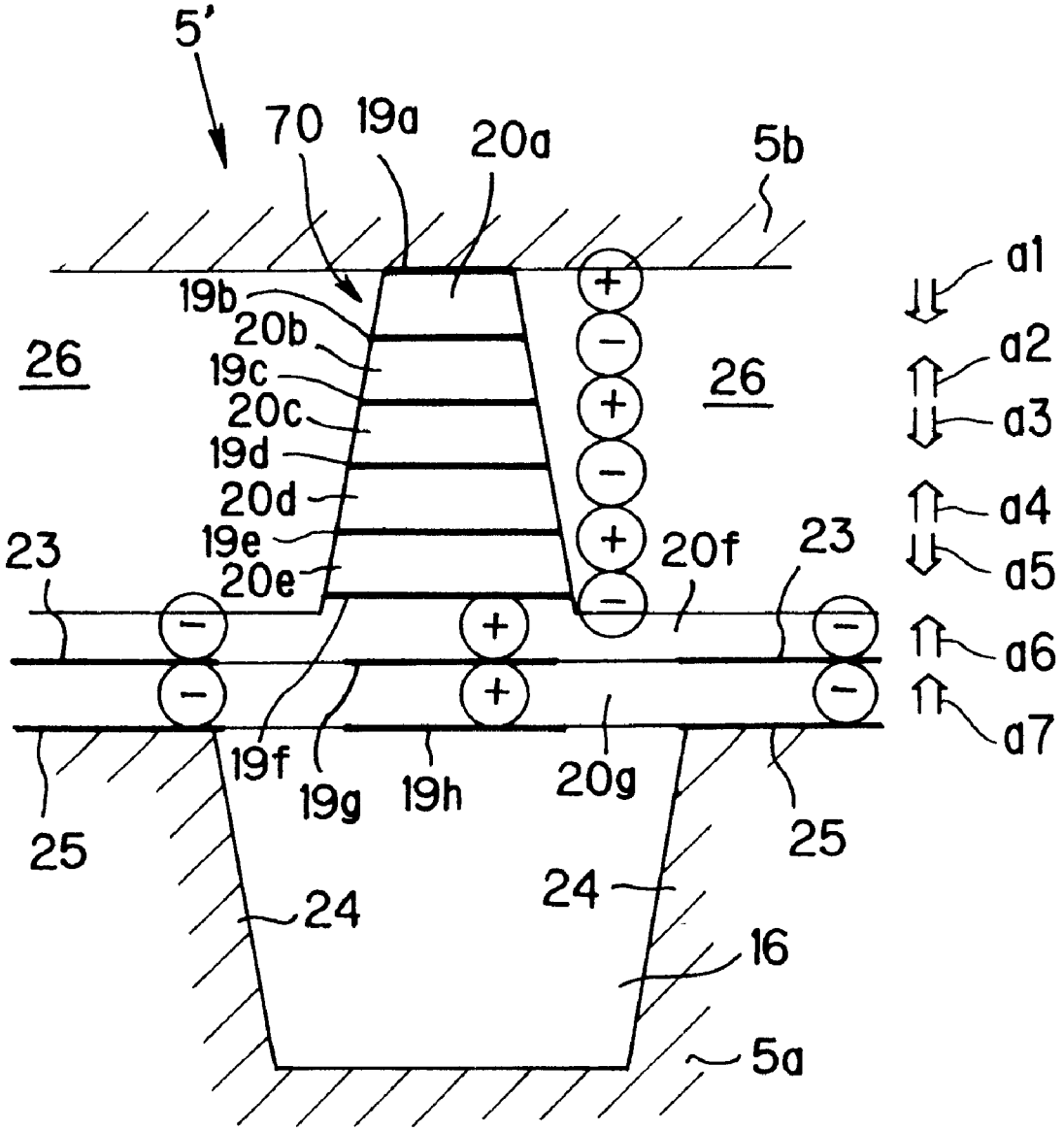
FIG. 9 is a sectional view of an inkjet head of a second embodiment of the present invention.

Referring to FIG. 9, an inkjet head of a second embodiment of the present invention is explained. In addition, in FIG. 9, the same constructional elements as those in FIG. 7 carry the same reference numbers and explanations with respect to these elements are omitted.

Compared with the inkjet head 5 shown in FIG. 7, the inkjet head 5' shown in FIG. 9 is different with respect to the arrangement of electrode layers. As shown in FIG. 5, in the inkjet head 5', the electrode layers 19*h* and 25 are formed on the underside of the base piezoelectric layer 20*g*. The electrode layers 19*h* are located at positions corresponding to the ink chambers 16, and the electrode layers 25 are located at positions corresponding to the peripheral portions 24. Like the electrode layers 19*g* and 23, the electrode layers 19*h* and 25 extend perpendicular to the surface of FIG. 9.

Furthermore, a positive voltage is applied to each of the electrode layer 19*h*, and a negative voltage is applied to each of the electrode layer 25. Therefore, an electric field whose direction is perpendicular to the polarization direction of the base piezoelectric layer 20*g* can be applied by using the electrode layers 19*h* and 25.

According to the inkjet head 5' of the second embodiment, the electric field can be applied to the base piezoelectric layers 20*f* and 20*g* by the cooperation of the electrode layers 19*g*, 19*h*, 23 and 25. Therefore, it is possible to make the angle between the direction of the electric field and the polarization direction closer to a right angle. As a result, each of the base piezoelectric layers 20*f* and 20*g* is distorted more largely and more dynamically by a low voltage. Consequently, it is possible to reduce the electric power for the ink ejection.

In addition, in FIG. 9, the surface of the electrode layer 19*h* is exposed to the inside of the ink chamber 16. Therefore, it is preferable that the surface of the electrode layer 19*h* may be covered with a protection membrane with object of protecting the electrode layer 19*h* and preventing electrification of the electrode layer 19*h*.

(IV) Third Embodiment

Figure 10:
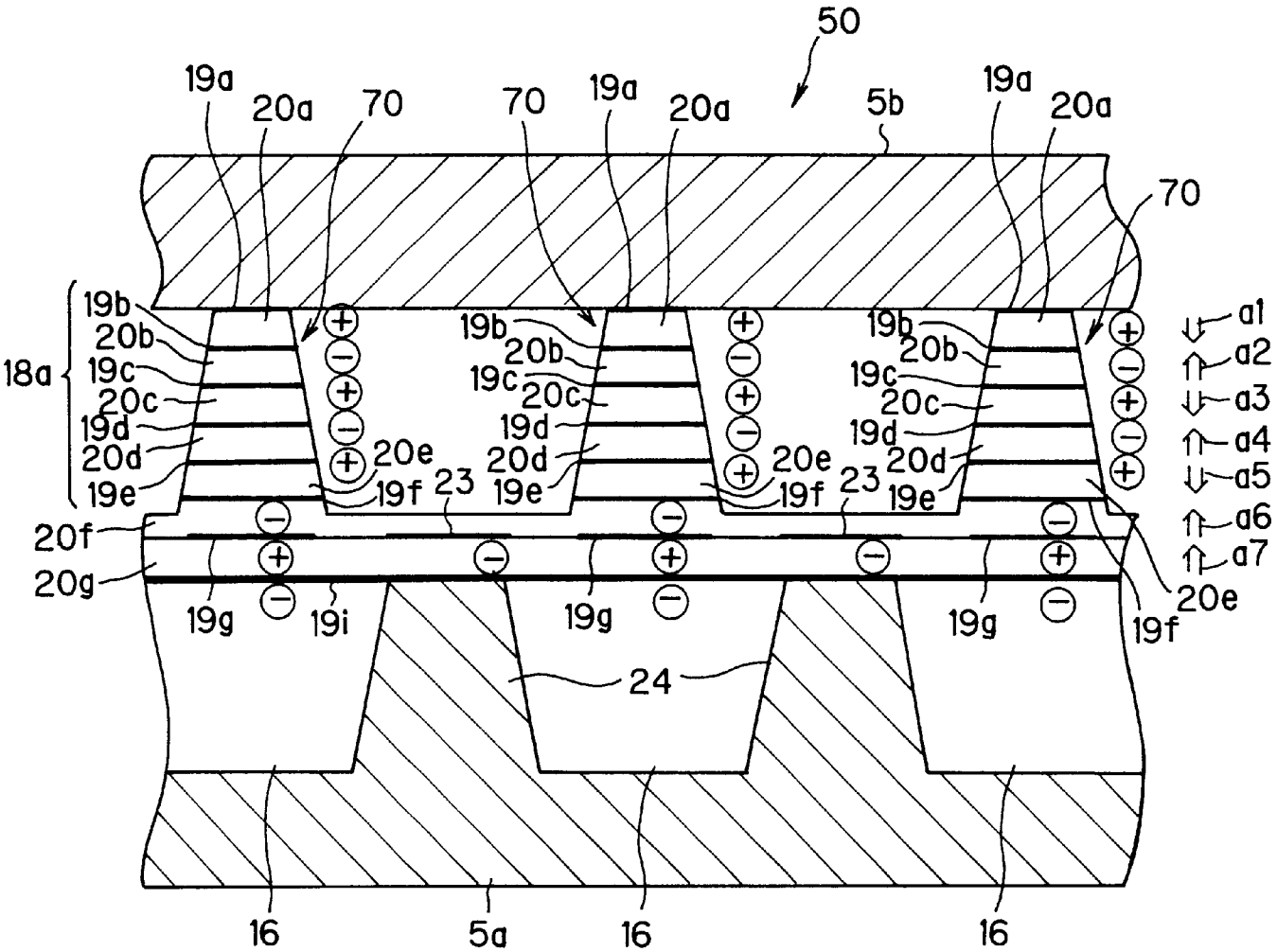
FIG. 10 is a sectional view of an inkjet head of a third embodiment of the present invention.
Figure 11A:
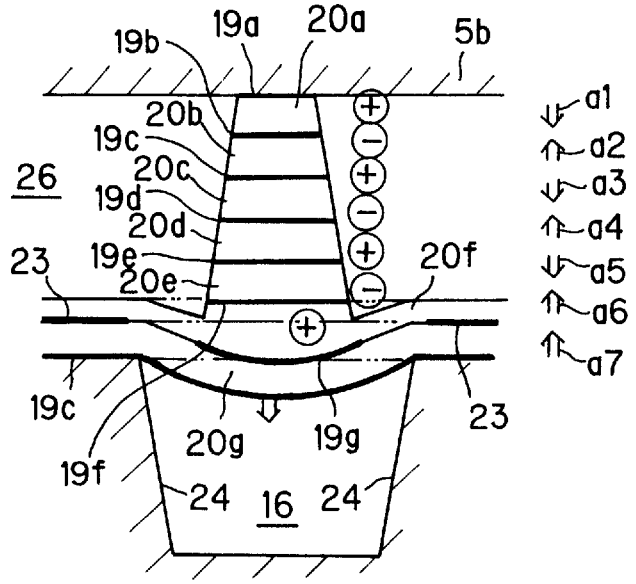
FIGS. 11A to 11C are sectional views each showing motion of a piezoelectric device of the inkjet head of the third embodiment.
Figure 11B:
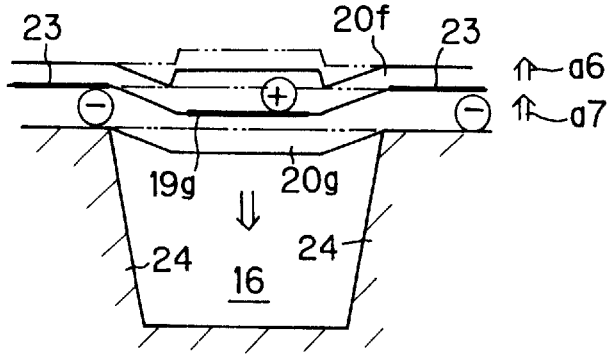
Figure 11C:
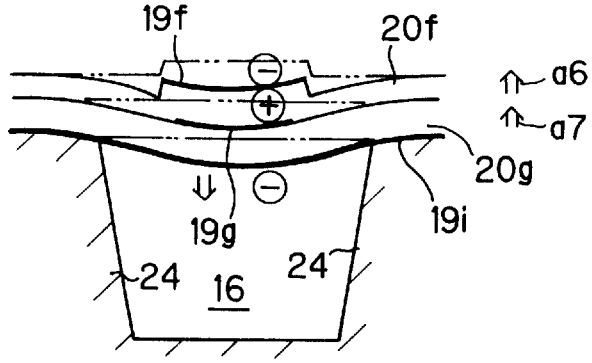

Referring to FIGS. 10 to 11C, an inkjet head of a third embodiment of the present invention is explained. In addition, in FIGS. 10 to 11C, the same constructional elements as those in FIGS. 7 to 8C carry the same reference numbers, and explanations with respect to these elements are omitted.

Compared to the inkjet head 5 shown in FIG. 7, the inkjet head 50 shown in FIG. 10 is different with respect to the arrangement of electrode layers. As shown in FIG. 10, in the inkjet head 50 of the third embodiment, the electrode layer 19*i* is disposed on the underside of the base piezoelectric layer 20*g*. The electrode layer 19*i* spreads over the respective ink chambers 16 and the respective peripheral portions 24. When the piezoelectric device 18 is driven, a negative voltage is applied to the electrode layer 19*i*. As shown in FIG. 11A, each of the piezoelectric layers 20*a* to 20*f* is distorted in the expansion mode by applying the voltages to the respective electrode layers 19*a* to 19*g*. As shown in FIG.

11B, each of the base piezoelectric layers 20*f* and 20*g* is distorted in the shear mode by applying the voltages to the respective electrode layers 19*g* and 23. Furthermore, each of the base piezoelectric layers 20*f* and 20*g* is distorted in a bimorph mode by applying the voltages to the respective electrode layers 19*f*, 19*g* and 19*i*. By the distortion in the bimorph mode, the base piezoelectric layer 20*g* protrudes to the inside of the ink chambers 16, as shown in FIG. 11C.

The bimorph mode is a distortion mode of piezoelectric elements. Namely, two piezoelectric layers are laminated each other. The piezoelectric layers are polarized in their thickness direction, and polarized in the same direction as each other. An electric field whose direction is opposite to the polarization direction is applied to one piezoelectric layer. As a result, this piezoelectric layer expands along its surface. On the other hand, another electric field whose direction is the same as the polarization direction is applied to the other piezoelectric layer. As a result, this piezoelectric layer shrinks along its surface. Since the two piezoelectric layers are fixed to each other, expansion or shrinkage of the fixed side of each of the piezoelectric layers is restricted. Consequently, the two piezoelectric layers curves.

Referring to FIG. 11C, the distortion of each of the base piezoelectric layers 20*f* and 20*g* in the bimorph mode is explained in detail.

As shown in FIG. 11C, an electric field whose direction is the same as the polarization direction of the base piezoelectric layer 20*f* is applied to the base piezoelectric layer 20*f* by using the electrode layers 19*f* and 19*g*. As a result, the base piezoelectric layer 20*f* shrinks along its surface. Furthermore, an electric field whose direction is opposite to the polarization direction of the base piezoelectric layer 20*g* is applied to the base piezoelectric layer 20*g* by using the electrode layers 19*g* and 19*i*. As a result, the base piezoelectric layer 20*g* expands along its surface. By these expansion and shrinkage, the base piezoelectric layer 20*g* protrudes to the inside of the ink chambers 16, and pressure is applied to the ink within the ink chambers 16.

Thus, by the cooperation of the distortion in the expansion mode, the distortion in the shear mode and the distortion in the bimorph mode, the base piezoelectric layer 20*g* is distorted. Therefore, according to the inkjet head 50 of the third embodiment, it is possible to distort the base piezoelectric layer 20*g* largely and dynamically by a relatively low voltage.

In addition, the surface of the electrode layer 19*i* is exposed to the inside of the ink chamber 16. Therefore, it is preferable that the surface of the electrode layer 19*i* may be covered with a protection membrane with object of protecting the electrode layer 19*i* and preventing electrification of the electrode layer 19*i*.

(V) Fourth Embodiment

Figure 12:
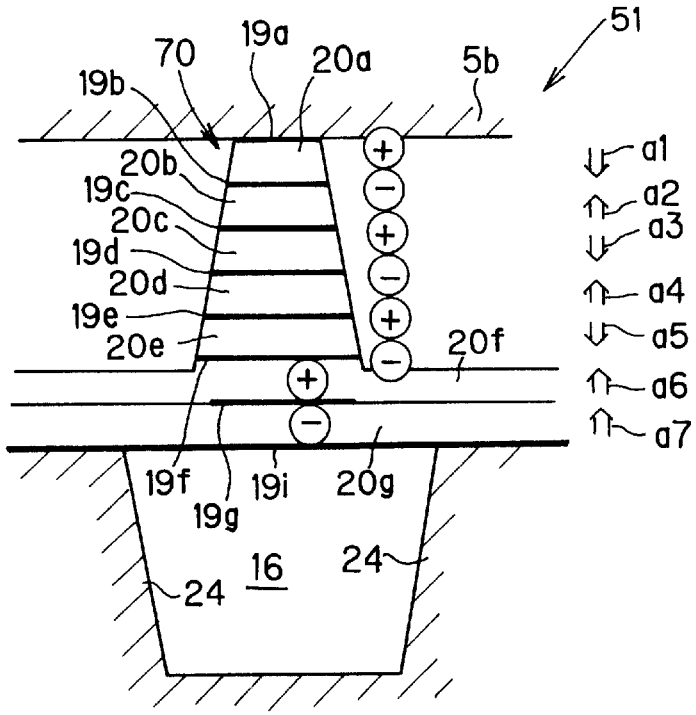
FIG. 12 is a sectional view of an inkjet head of a forth embodiment of the present invention.

Referring to FIG. 12, an inkjet head of a fourth embodiment of the present invention is explained. In addition, in FIG. 12, the same constructional elements as those in FIG. 10 carry the same reference numbers and explanations with respect to these elements are omitted.

Compared with the inkjet head 50 shown in FIG. 10, the inkjet head 51 shown in FIG. 12 is different with respect to the arrangement of electrode layers. As shown in FIG. 12, in the inkjet head 51, only the plurality of electrode layers 19*g* (One of which is depicted.) are disposed between the base piezoelectric layers 20*f* and 20*g*. Namely, in the aforementioned inkjet head 50 shown in FIG. 10, the electrode layers 23 are arranged between the base piezoelectric layers 20*f* and 20*g* at the positions corresponding to the peripheral portions 24. However, in the inkjet head 51 shown in FIG. 12, there is no electrode layer at the position corresponding to each of the peripheral portions 24 between the base piezoelectric layers 20*f* and 20*g*.

Therefore, in the inkjet head 51, each of the piezoelectric layers 20*a* to 20*f* is distorted in the expansion mode, and each of the base piezoelectric layers 20*f* and 20*g* is distorted in the bimorph mode. As a result, the base piezoelectric layer 20*g* protrudes to the inside of the ink chambers 16. Consequently, it is possible to simplify the construction of the piezoelectric device, providing large and dynamic distortion by low electric power.

(VI) Fifth Embodiment

Figure 13:
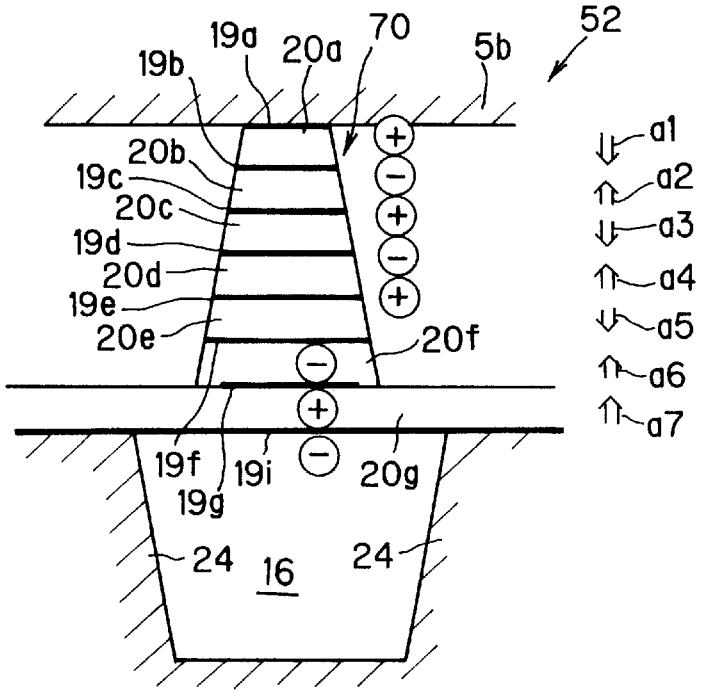
FIG. 13 is a sectional view of an inkjet head of a fifth embodiment of the present invention.

Referring to FIG. 13, an inkjet head of a fifth embodiment of the present invention is explained. In addition, in FIG. 13, the same constructional elements as those in FIG. 12 carry the same reference numbers and explanations with respect to these elements are omitted.

Compared with the inkjet head 51 shown in FIG. 12, the inkjet head 52 shown in FIG. 13 is different with respect to the base piezoelectric layer 20*f*. As shown in FIG. 13, in the inkjet head 52, the base piezoelectric layer 20*f* is disposed only at the position corresponding to each of the ink chambers 16. According to the inkjet head 52, the same advantage as the inkjet head 51 can be obtained.

(VII) Sixth Embodiment

Figure 14:
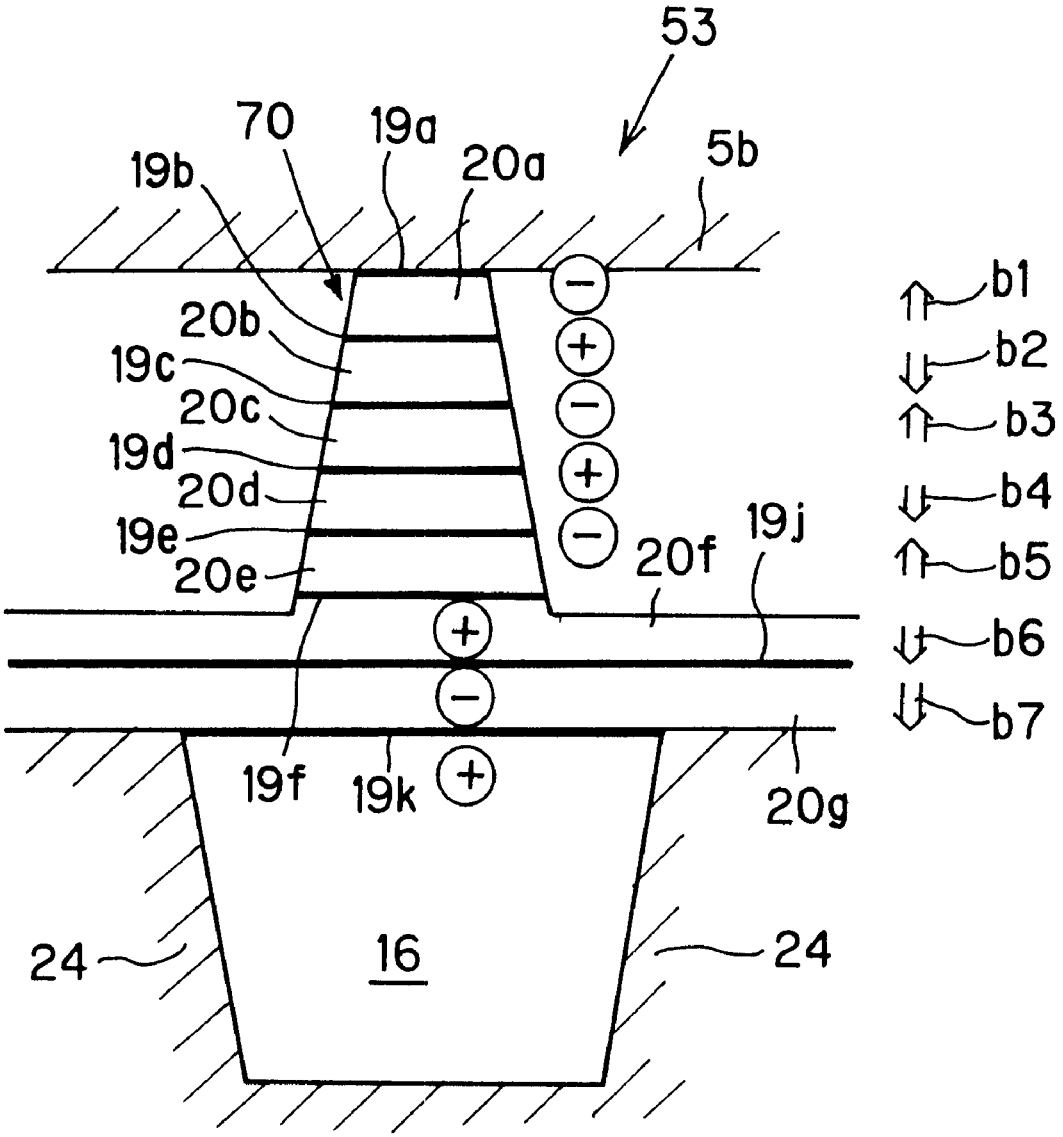
FIG. 14 is a sectional view of an inkjet head of a sixth embodiment of the present invention.

Referring to FIG. 14, an inkjet head of a sixth embodiment of the present invention is explained. In addition, in FIG. 14, the same constructional elements as those in FIG. 7 carry the same reference numbers and explanations with respect to these elements are omitted.

Compared with the inkjet head 5 shown in FIG. 7, the inkjet head 53 shown in FIG. 14 is different with respect to the arrangement of electrode layers. As shown in FIG. 14, in the inkjet head 53, the electrode layer 19*j* is disposed between the base piezoelectric layers 20*f* and 20*g*. The electrode layer 19*j* spreads over the respective ink chambers 16 and the respective peripheral portions 24. Furthermore, the electrode layers 19*k* are disposed on the underside of the base piezoelectric layer 20*g*. The electrode layers 19*k* located at the positions corresponding to the ink chambers.

In the inkjet head 53, each of the piezoelectric layers 20*a* to 20*g* is polarized as shown by arrows b1 to b7 in FIG. 14. Compared with the inkjet head 50 shown in FIG. 7, all of the piezoelectric layers 20*a* to 20*g* are polarized in the opposite direction, respectively. Furthermore, as shown in FIG. 14, a negative voltage is applied to each of the electrode layers 19*a*, 19*c*, 19*e* and 19*j*, and a positive voltage is applied to each of the electrode layers 19*b*, 19*d*, 19*f* and 19*k*. In addition, each of the electrode layers 19*k* extends perpendicular to the surface of FIG. 14, and is formed in the shape corresponding to the opening shape of the ink chamber 16.

In such a construction, each of the piezoelectric layers 20*a* to 20*f* is distorted in the expansion mode. Each of the base piezoelectric layers 20*f* and 20*g* is distorted in the bimorph mode. As a result, the base piezoelectric layer 20*g* protrudes to the inside of the ink chambers 16. Consequently, it is possible to distort the base piezoelectric layer 20*g* largely and dynamically by a low voltage and simplify the construction of the piezoelectric device.

In addition, in FIG. 14, the surface of the electrode layer 19*k* is exposed to the inside of the ink chamber 16. Therefore, it is preferable that the surface of the electrode layer 19*k* may be covered with a protection membrane with object of protecting the electrode layer 19*k* and preventing electrification of the electrode layer 19*k*.

(VIII) Seventh Embodiment

Figure 15:
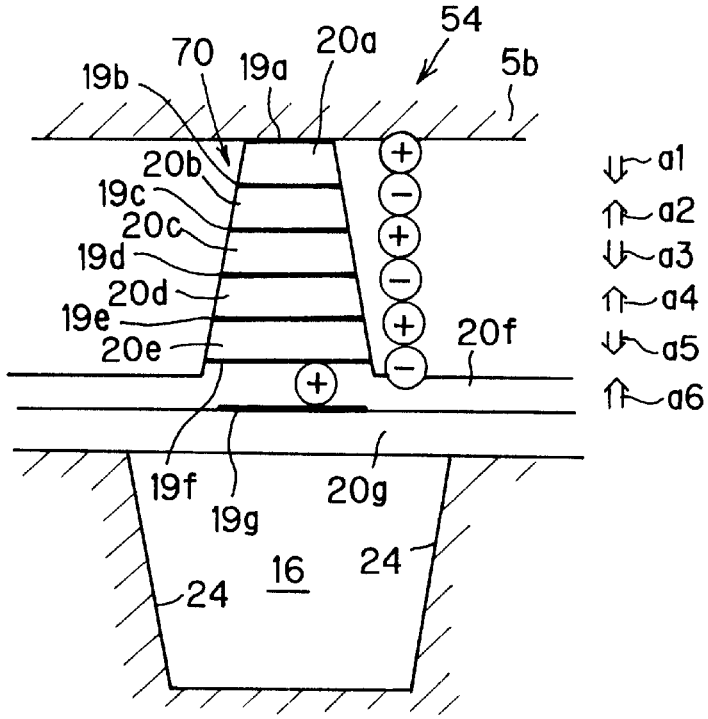
FIG. 15 is a sectional view of an inkjet head of a seventh embodiment of the present invention.

Referring to FIG. 15, an inkjet head of a seventh embodiment of the present invention is explained. In addition, in FIG. 15, the same constructional elements as those in FIG. 10 carry the same reference numbers and explanations with respect to these elements are omitted.

Compared with the inkjet head 50 shown in FIG. 10, the inkjet head 54 shown in FIG. 15 is different with respect to the arrangement of electrode layers. As shown in FIG. 15, there is no electrode layer at the position corresponding to the peripheral portion 24. Furthermore, there is no electrode layer on the underside of the base piezoelectric layer 20*g*. The polarity of voltage applied to each of the electrode layers 19*a* to 19*g* is the same as that in the inkjet head 50 shown in FIG. 10. Furthermore, the base piezoelectric layer 20*g* may not be polarized.

In such a construction, each of the piezoelectric layers 20*a* to 20*f* is distorted in the expansion mode. Furthermore, the base piezoelectric layer 20*f* is distorted in the unimorph mode, together with the base piezoelectric layer 20*g*. At this time, the base piezoelectric layer 20*g* functions as a restriction layer to allow the base piezoelectric layer 20*f* to be distorted in the unimorph mode. As a result, the base piezoelectric layer 20*g* protrudes to the inside of the ink chambers 16.

Consequently, it is possible to simplify the construction of the piezoelectric device, providing an advantage that large and dynamic distortion can be obtained by a low voltage.

In addition, the base piezoelectric layer 20*g* can be made of an elastic material having an optimum stiffness similar to the piezoelectric material, instead of the piezoelectric material.

(IX) Eighth Embodiment

Figure 16:
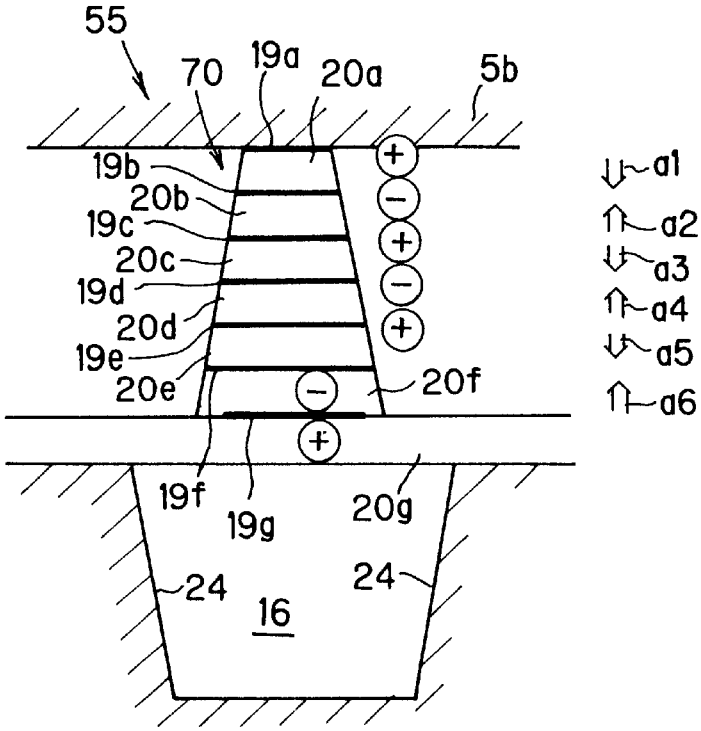
FIG. 16 is a sectional view of an inkjet head of an eighth embodiment of the present invention.

Referring to FIG. 16, an inkjet head of an eighth embodiment of the present invention is explained. In addition, in FIG. 16, the same constructional elements as those in FIG. 15 carry the same reference numbers and explanations with respect to these elements are omitted.

Compared with the inkjet head 54 shown in FIG. 15, the inkjet head 55 shown in FIG. 16 is different with respect to the base piezoelectric layer 20*f*. As shown in FIG. 16, the base piezoelectric layer 20*f* is disposed only at the position corresponding to each of the ink chambers 16. According to the inkjet head 55, the same advantage as the inkjet head 54 can be obtained.

In addition, the base piezoelectric layer 20*g* can be made of an elastic material having an optimum stiffness similar to the piezoelectric material, instead of the piezoelectric material.

(X) Ninth Embodiment

Figure 17:
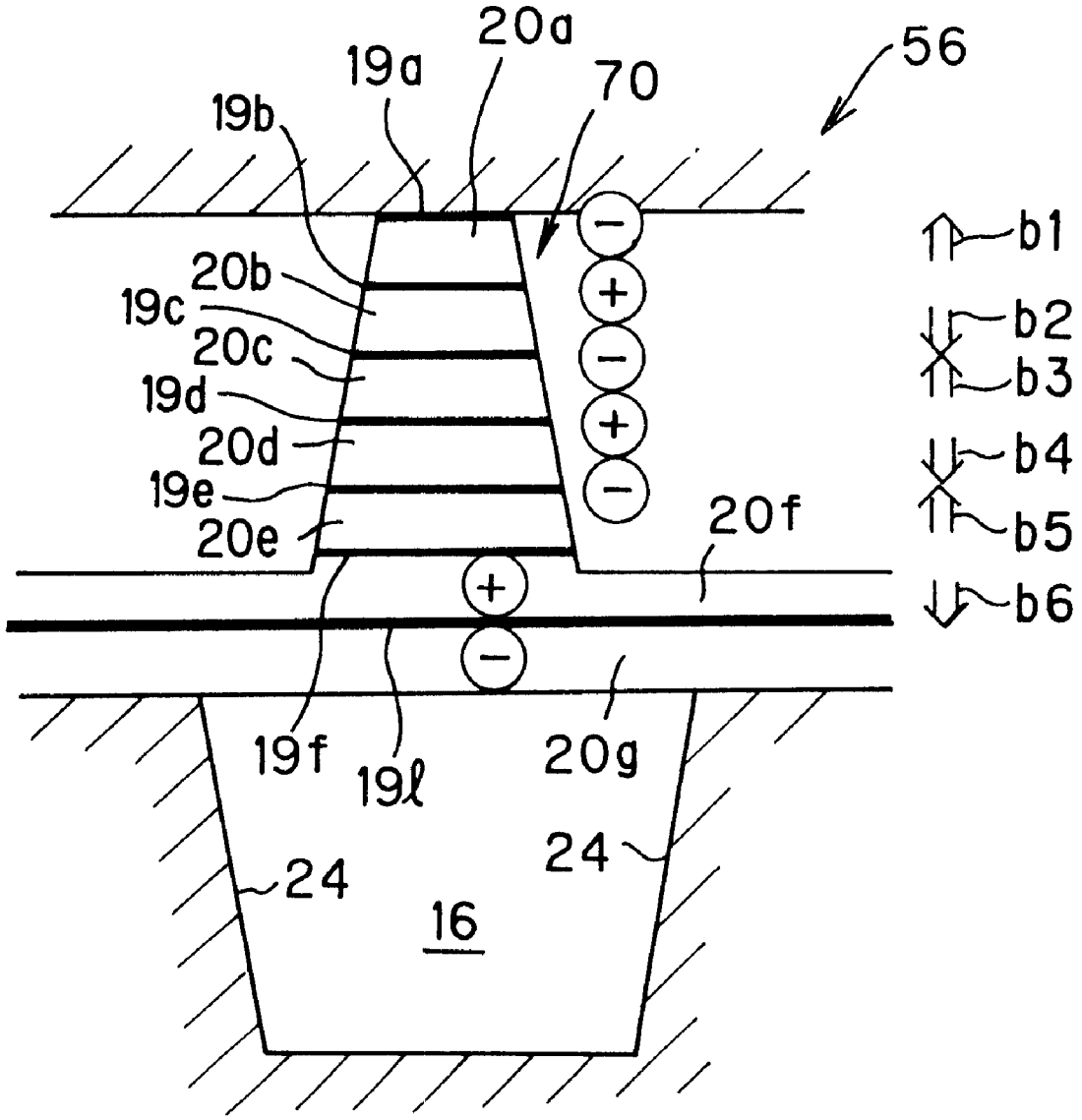
FIG. 17 is a sectional view of an inkjet head of a ninth embodiment of the present invention.

Referring to FIG. 17, an inkjet head of a ninth embodiment of the present invention is explained. In addition, in FIG. 17, the same constructional elements as those in FIG. 10 carry the same reference numbers and explanations with respect to these elements are omitted.

Compared with the inkjet head 50 shown in FIG. 10, the inkjet head 56 shown in FIG. 17 is different with respect to the arrangement of electrode layers. As shown in FIG. 17, in the inkjet head 56, the electrode layer 191 is disposed between the base piezoelectric layers 20*f* and 20*g*. The electrode layer 191 spreads over the respective ink chambers 16 and the respective peripheral portion 24. Unlike the inkjet head 50 shown in FIG. 10, in the inkjet head 56 shown in FIG. 17, there is no electrode layer on the underside of the base piezoelectric layer 20*g*. Furthermore, in the inkjet head 56, the polarization directions of the piezoelectric layers 20*a* to 20*f* are opposite to those in the inkjet head 50, respectively. Moreover, a negative voltage is applied to each of the electrode layers 19*a*, 19*c*, 19*e* and 191, and a positive voltage is applied to each of the electrode layers 19*b*, 19*d* and 19*f*. In addition, the base piezoelectric layer 20*g* may not be polarized. Furthermore, the electrode layer 191 extends perpendicular to the surface of FIG. 17, and is formed in the shape corresponding to the opening shape of each of the ink chambers 16.

In such a construction, each of the piezoelectric layers 20*a* to 20*f* is distorted in the expansion mode. Furthermore, the base piezoelectric layer 20*f* is distorted in the unimorph mode, together with the base piezoelectric layer 20*g*. At this time, the base piezoelectric layer 20*g* functions as a restriction layer to allow the base piezoelectric layer 20*f* to be distorted in the unimorph mode.

Consequently, it is possible to simplify the construction of the piezoelectric device, providing an advantage that large and dynamic distortion can be obtained by a low voltage.

In addition, the base piezoelectric layer 20*g* can be made of an elastic material having an optimum stiffness similar to the piezoelectric material, instead of the piezoelectric material.

(XI) Tenth Embodiment

Figure 18:
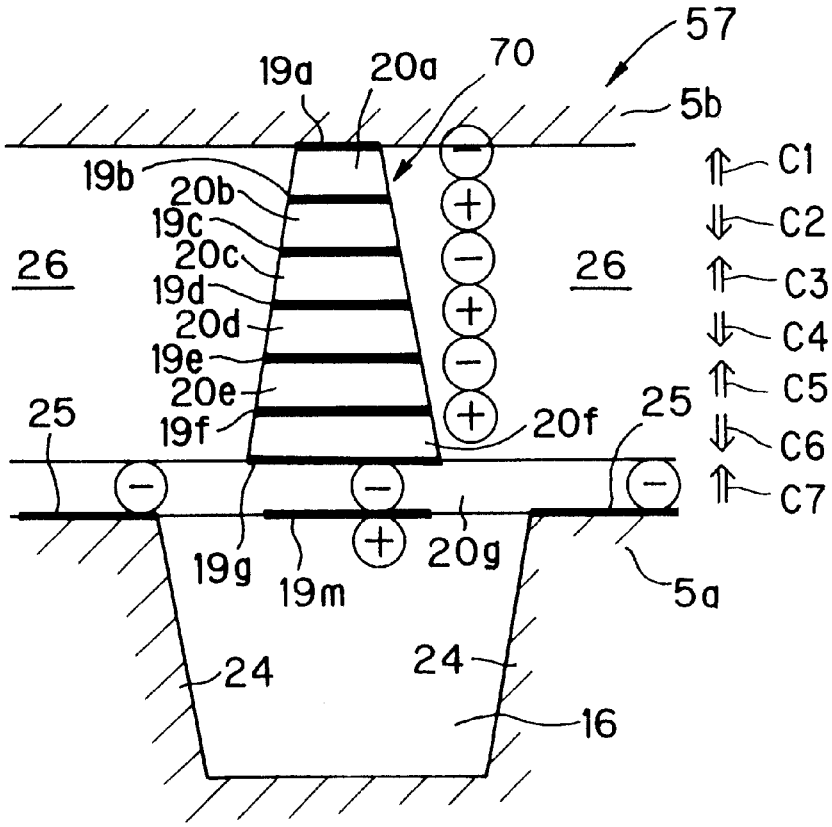
FIG. 18 is a sectional view of an inkjet head of a tenth embodiment of the present invention.

Referring to FIG. 18, an inkjet head of a tenth embodiment of the present invention is explained. In addition, in FIG. 18, the same constructional elements as those in FIG. 7 carry the same reference numbers and explanations with respect to these elements are omitted.

Compared with the inkjet head 5 shown in FIG. 7, the inkjet head 57 shown in FIG. 18 is different with respect to the arrangement of electrode layers and the base piezoelectric layer 20*f*. As shown in FIG. 18, in the inkjet head 57, the base piezoelectric layer 20*f* is disposed only at the position corresponding to each of the ink chambers 16. The electrode layer 19*g* is disposed between the base piezoelectric layers 20*f* and 20*g*, and located at the position corresponding to each of the ink chambers 16. Furthermore, the electrode layers 19*m* and 25 are arranged on the underside of the base piezoelectric layer 20*g*. The electrode layers 19*m* are located at positions corresponding to the ink chambers 16, respectively. The electrode layers 25 are located at positions corresponding to the peripheral portions 24, respectively. Each of the electrode layers 19*m* and 25 extends perpendicular to the surface of FIG. 18 Each electrode layer 19*m* is formed in the shape corresponding to the opening shape of each of the ink chambers 16. Each electrode layer 25 is formed in the shape corresponding to the shape of the top surface of each of the peripheral portions 24.

Furthermore, the piezoelectric layers 20*a* to 20*g* are respectively polarized in the predetermined direction shown by arrows C1 to C7. In this case, a negative voltage is applied to each of the electrode layers 19*a*, 19*c*, 19*e* and 19*g*, and a positive voltage is applied to each of the electrode layers 19*b*, 19*d* and 19*f*. Moreover, a positive voltage is applied to each of the electrode layers 19*m*, and a negative voltage is applied to each of the electrode layers 25.

In such a construction, each of the piezoelectric layers 20*a* to 20*g* is distorted in the expansion mode, and the base piezoelectric layer 20*g* is distorted in the shear mode. As a result, the base piezoelectric layer 20*g* protrudes to the inside of the ink chambers 16.

Consequently, it is possible to simplify the construction of the piezoelectric device, providing an advantage that large and dynamic distortion can be obtained by a low voltage.

(XII) Eleventh Embodiment

Figure 19:
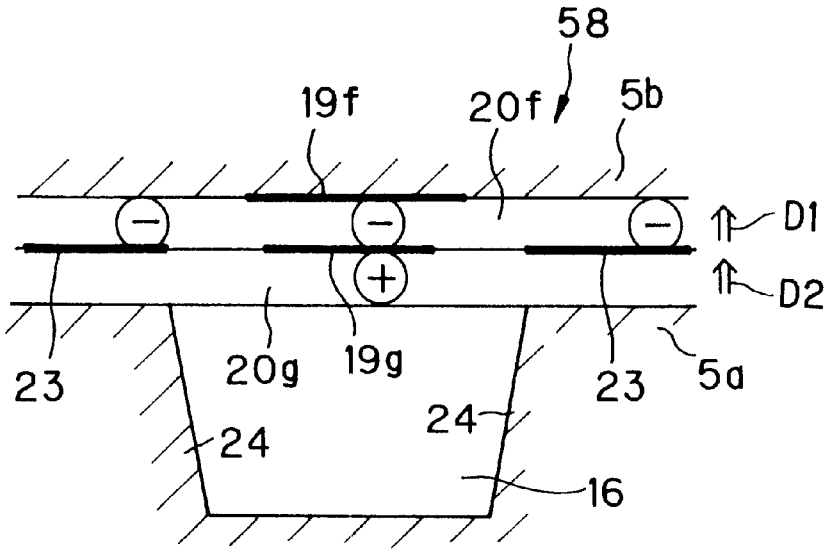
FIG. 19 is a sectional view of an inkjet head of an eleventh embodiment of the present invention.

Referring to FIG. 19, an inkjet head of an eleventh embodiment of the present invention is explained. In addition, in FIG. 19, the same constructional elements as those in FIG. 7 carry the same reference numbers and explanations with respect to these elements are omitted.

As shown in FIG. 19, in an inkjet head 58, the piezoelectric device has a couple of the base piezoelectric layers 20*f* and 20*g*. The base piezoelectric layers 20*f* and 20*g* are laminated each other, and disposed between the plate portion 5*a* and the holding member 5*b*. Each of the base piezoelectric layers 20*f* and 20*g* spreads over the respective ink chambers 16 and the respective peripheral portions 24.

The electrode layer 19*f* is disposed on the upside of the base piezoelectric layer 20*f*, and located at a position corresponding to each of the ink chambers 16. The electrode layers 19*g* and 23 are arranged between the base piezoelectric layers 20*f* and 20*g*. The electrode layer 19*g* is located at a position corresponding to each of the ink chambers 16. The electrode layer 23 is located at a position corresponding to each of the peripheral portions 24. Each of the electrode layers 19*f*, 19*g* and 23 extends perpendicular to the surface of FIG. 19, and is formed in the shape corresponding to the opening shape of the ink chamber 16 or the shape of the top surface of the peripheral portion 24.

Furthermore, the piezoelectric layers 20*f* and 20*g* are respectively polarized in the predetermined direction shown by arrows D1 and D2. Moreover, a positive voltage is applied to each of the electrode layers 19*g*, and a negative voltage is applied to each of the electrode layers 19*f* and 23.

In such a construction, the base piezoelectric layer 20*f* is distorted in the unimorph mode, together with the base piezoelectric layer 20*g*. At this time, the base piezoelectric layer 20*g* functions as a restriction layer. Furthermore, the base piezoelectric layers 20*f* and 20*g* are distorted in the shear mode. As a result, the base piezoelectric layer 20*g* protrudes to the inside of the ink chambers 16.

Consequently, it is possible to simplify the construction of the piezoelectric device, providing an advantage that large and dynamic distortion can be obtained by a low voltage.

In addition, the electrode layer 19*f* may spread over the respective ink chambers 16 and the respective peripheral portions 24.

(XIII) First Manufacturing Method for Inkjet Head of First Embodiment

Figure 20A:
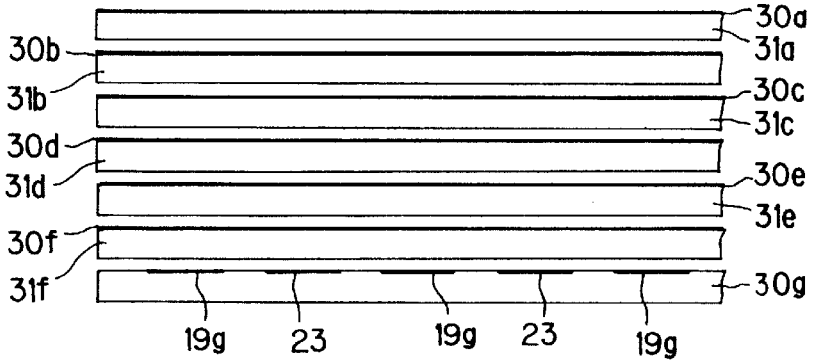
FIGS. 20A to 20C are sectional views showing a manufacturing method of the inkjet head of the first embodiment.
Figure 20B:
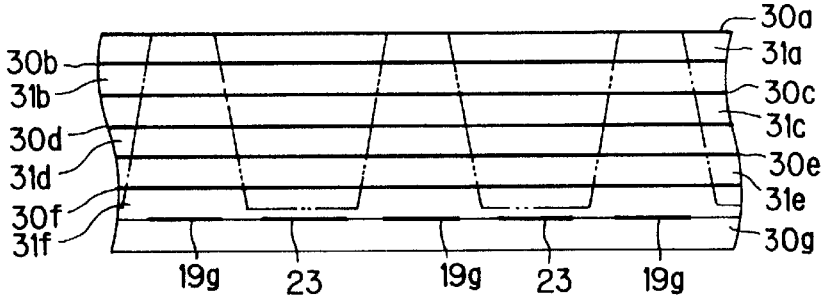
Figure 20C:
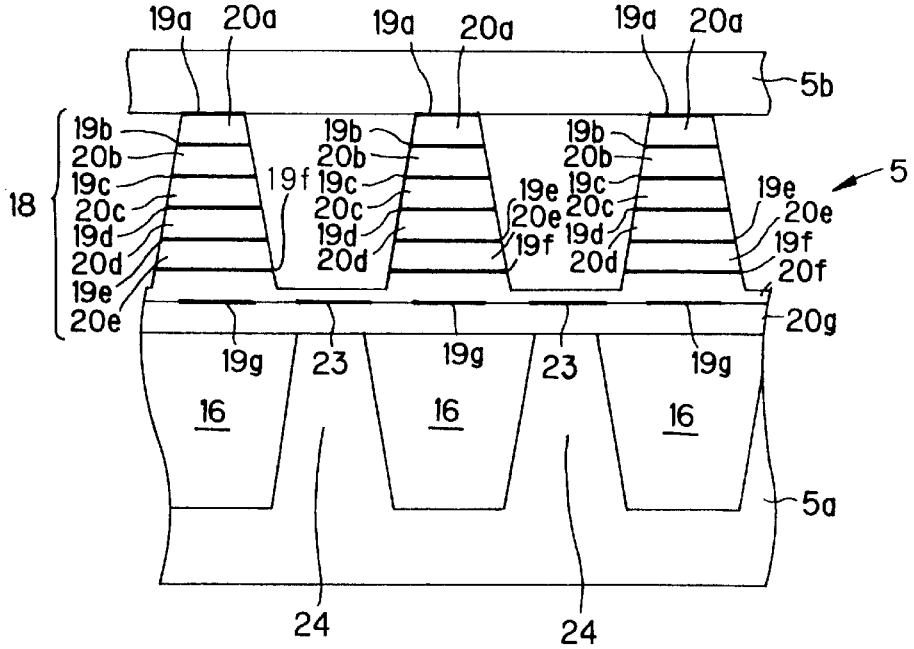

Referring to FIGS. 20A to 20C, a manufacturing method for the inkjet head 5 shown in FIG. 7 is explained.

First, as shown in FIG. 20A, a sheet shaped piezoelectric element 30*g* is prepared as the piezoelectric layer 20*g*. The electrode layers 19*g* and 23 are formed on the sheet shaped piezoelectric element 30*g* by using a screen process printing or the like. Each of the electrode layers 19*g* and 23 is positioned at a predetermined position in consideration of the positions of ink chambers 16 and peripheral portions 24. Furthermore, sheet shaped piezoelectric elements 31*a* to 31*f* fare prepared. The electrode membranes 30*a* to 30*f* are formed on the sheet shaped piezoelectric elements 31*a* to 31*f*, respectively, by using a screen process printing or the like. Next, these sheet shaped piezoelectric elements 31*a* to 31*g* are laminated, and bonded respectively by using a vacuum press method or the like. Then, the laminated sheet shaped piezoelectric elements 31*a* to 31*g* are sintered. Next, a process to polarize each of the sheet shaped piezoelectric elements 31*a* to 31*g* in the predetermined direction shown in FIG. 7 is performed.

Next, resist is applied onto the upside of the electrode membrane 30*a* at the parts corresponding to the electrode layer 19*a* to form a mask pattern. Next, an etching process, for example, a dry etching using particles such as silicon carbide (shot blast method) is performed to remove unnecessary parts from the laminated piezoelectric elements 31*a* to 31*g*. Thus, as shown in FIG. 20B, the part shown by the chain double-dashed line remains, and the electrode layers 19*a* to 19*f* and the piezoelectric layers 20*a* to 20*g* are formed.

Next, as shown in FIG. 20C, the cavity plate 5*a* on which the ink chambers 16 and the peripheral portions 24 have been formed is bonded to the piezoelectric layer 20*g*, and the holding member 5*b* is bonded onto the top surface of the electrode layers 19*a*. Thus, the inkjet head 5 is completed.

According to the aforementioned manufacturing method, it is possible to manufacture the inkjet head 5 easily and accurately. Namely, since the piezoelectric layers 20*a* to 20*f* are formed by the etching process after the sheet shaped piezoelectric elements 31*a* to 31*g* are laminated, the piezoelectric layers 20*a* to 20*f* can be accurately situated at the positions corresponding to ink chambers 16. Furthermore, since the sheet shaped piezoelectric elements 31*a* to 31*g* are laminated and sintered, it is possible to prevent the piezoelectric elements from being distorted due to sintering. Moreover, since the electrode layers 19*a* to 19*f* are formed by the etching process after the electrode membrane 31*a* to 31*f* are laminated, the electrode layers 19*a* to 19*f* can be accurately situated at the positions corresponding to ink chambers 16.

(XIV) Second Manufacturing Method for Inkjet Head of First Embodiment

Figure 21A:
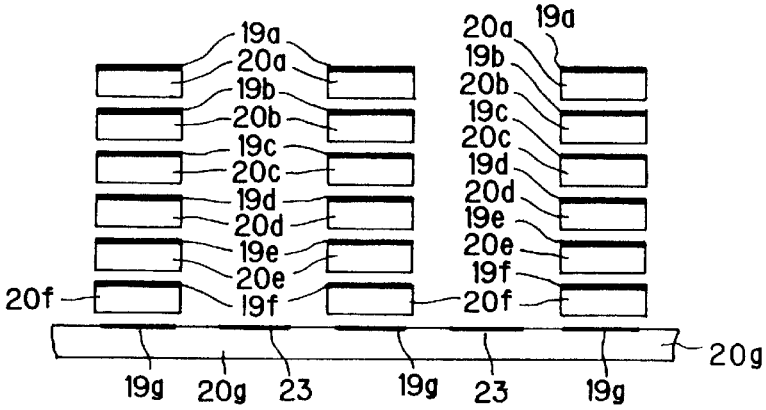
FIGS. 21A to 21C are sectional views showing another manufacturing method of the inkjet head of the first embodiment.
Figure 21B:
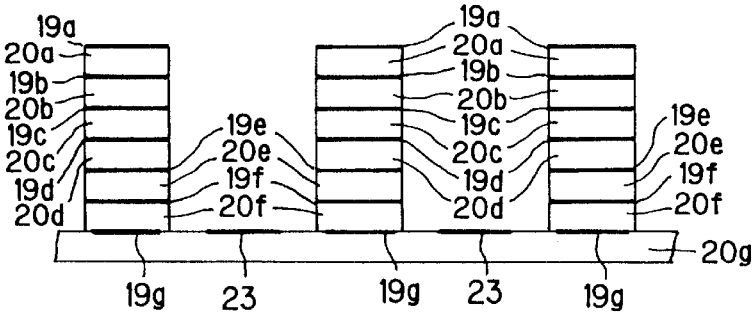
Figure 21C:
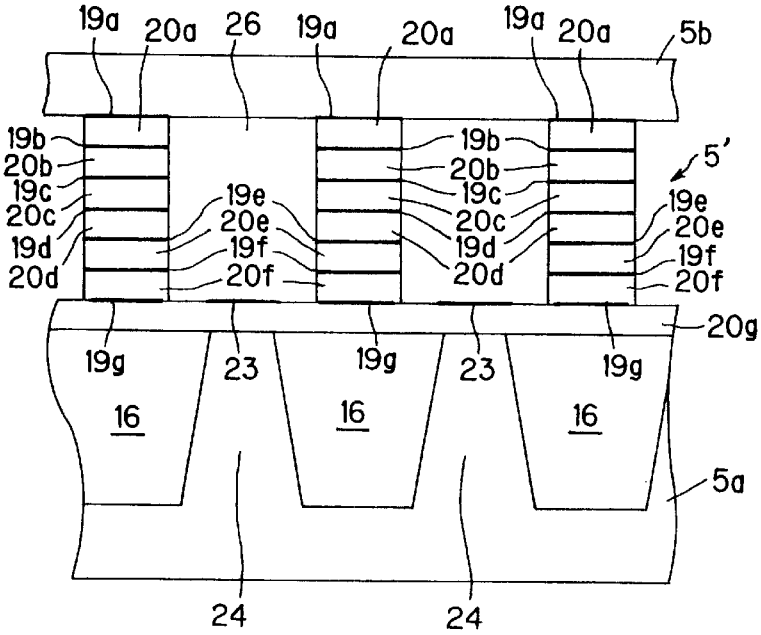

Referring to FIGS. 21A to 21C, another manufacturing method for the inkjet head 5 is explained.

First, as shown in FIG. 21A, the piezoelectric layers 20*a* to 20*f* which have been formed in the shape corresponding to the opening shape of the ink chamber 16 respectively, and on which the electrode layers 19*a* to 19*f* have been formed respectively, are laminated on the piezoelectric layer 20*g* on which the electrode layers 19*g* and 23 have been formed. The electrode layers 19*a* to 19*g* and 23 are formed by using a screen process printing or the like. Also, the screen process printing can be used for laminating the piezoelectric layers 20*a* to 20*g*. Next, as shown in FIG. 21B, the laminated piezoelectric layers 20*a* to 20*g* are respectively bonded by using a vacuum press method or the like, and are sintered. Next, a process to polarize each of the piezoelectric layers 20*a* to 20*g* in the predetermined direction shown in FIG. 7 is performed.

Next, as shown in FIG. 21C, the cavity plate 5*a* on which the ink chambers 16 and the peripheral portions 24 have been formed is bonded to the piezoelectric layer 20*g*, and the holding plate 5*b* is bonded onto the top surface of the electrode layers 19*a*. Thus, the inkjet head 5 is completed.

According to this manufacturing method, since the piezoelectric layers 20*a* to 20*f* which have been formed in the shape corresponding to the opening shape of the ink chamber 16 are used, it is possible to produce the inkjet head 5 without an etching process. Furthermore, since the piezoelectric layers 20*a* to 20*f* on which the electrode layers 19*a* to 19*f* have been formed are laminated, the electrode layers 19*a* to 19*f* can be accurately situated.

(XV) Manufacturing Method for Inkjet Head of Fourth Embodiment

Figure 22A:
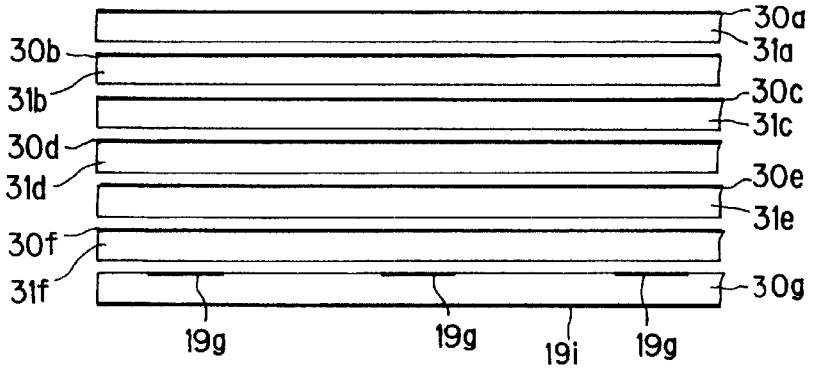
FIGS. 22A to 22C are sectional views showing a manufacturing method of the inkjet head of the fourth embodiment.
Figure 22B:
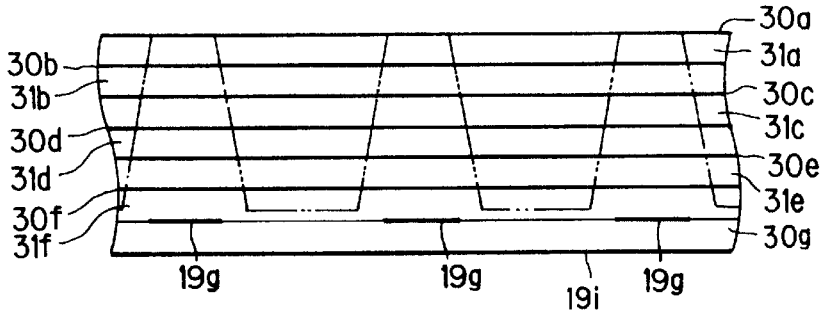
Figure 22C:
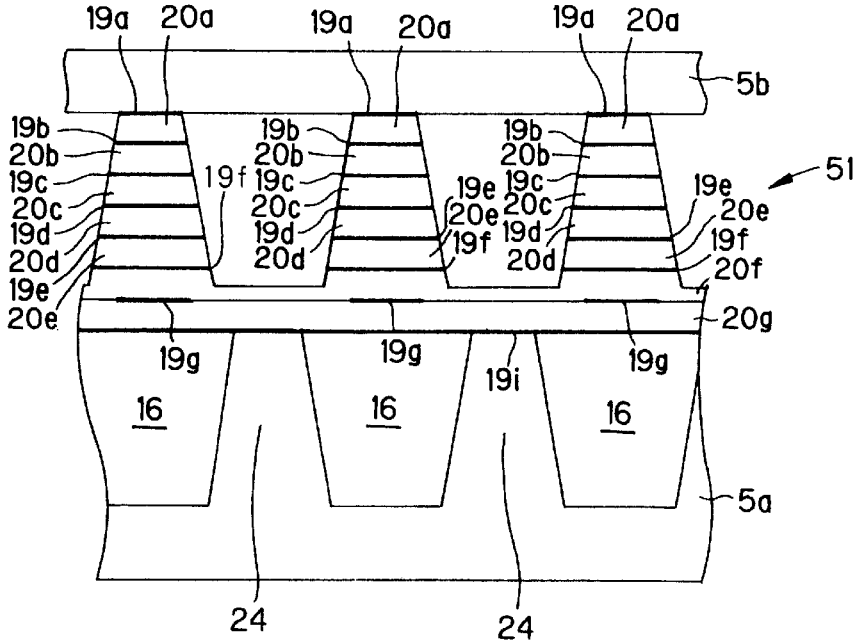

Referring to FIGS. 22A to 22C, a manufacturing method for the inkjet head 51 of the fourth embodiment is explained.

First, as shown in FIG. 22A, a sheet shaped piezoelectric element 30*g* is prepared as the piezoelectric layer 20*g*. The electrode layers 19*g* are formed on the upside of the sheet shaped piezoelectric element 30*g* by a screen process printing or the like, and the electrode layer 19*i* is formed on the underside of the sheet shaped piezoelectric element 30*g* by a screen process printing or the like. The electrode layer 19*i* widely spreads on the underside. Furthermore, sheet shaped piezoelectric elements 31*a* to 31*f* are prepared. The electrode membranes 30*a* to 30*f* are formed on the sheet shaped piezoelectric elements 31*a* to 31*f*, respectively, by a screen process printing or the like. Next, these sheet shaped piezoelectric elements 31*a* to 31*g* are laminated, and bonded respectively by a vacuum press method or the like. Then, the laminated sheet shaped piezoelectric elements 31*a* to 31*g* are sintered. Next, a process to polarize each of the sheet shaped piezoelectric elements 31*a* to 31*g* in the predetermined direction shown in FIG. 12 is performed.

Next, resist is applied onto the electrode membrane 30*a* at the parts corresponding to the electrode layer 19*a* to form a mask pattern. Next, an etching process is performed to remove unnecessary parts from the laminated piezoelectric elements 31*a* to 31*g*. Thus, as shown in FIG. 22B, the part shown by the chain double-dashed line remains, and the electrode layers 19*a* to 19*f* and the piezoelectric layers 20*a* to 20*g* are formed.

Next, as shown in FIG. 22C, the cavity plate 5*a* on which the ink chambers 16 and the peripheral portions 24 have been formed is bonded to the piezoelectric layer 20*g*, and the holding member 5*b* is bonded onto the top surface of the electrode layers 19*a*. Thus, the inkjet head 5 is completed.

According to the aforementioned manufacturing method, it is possible to manufacture the inkjet head 51 easily and accurately.

(XVI) Manufacturing Method for Inkjet Head of Fifth Embodiment

Figure 23A:
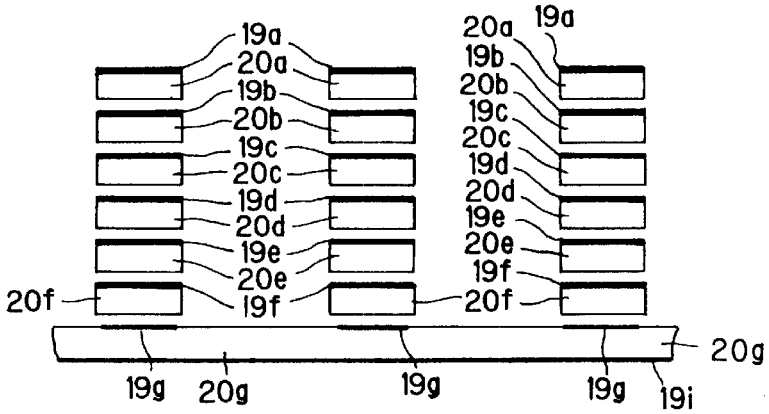
FIGS. 23A to 23C are sectional views showing a manufacturing method of the inkjet head of the fifth embodiment.
Figure 23B:
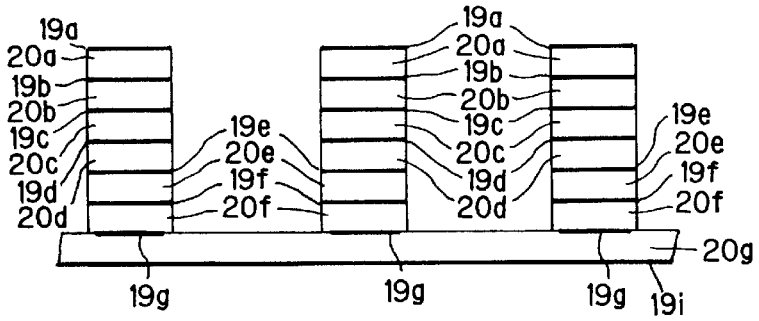
Figure 23C:
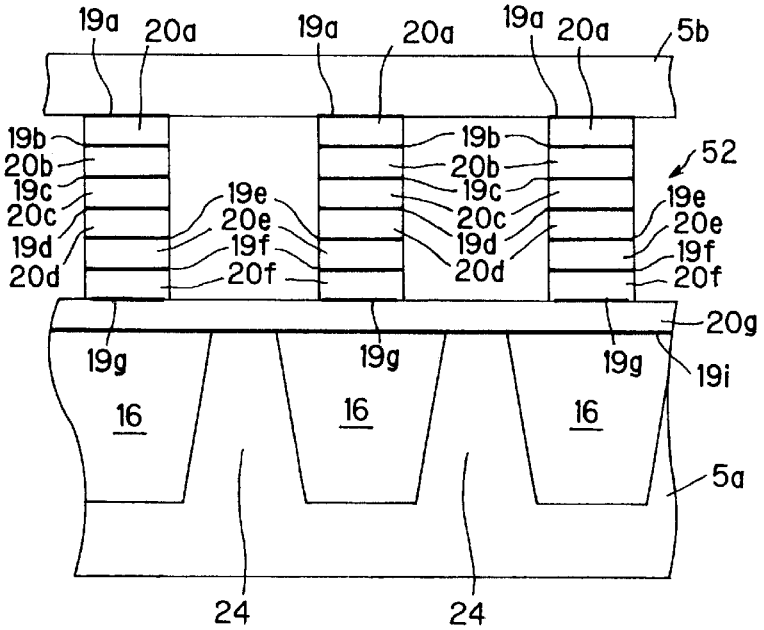

Referring to FIGS. 23A to 23C, a manufacturing method for the inkjet head 52 of the fifth embodiment is explained.

First, as shown in FIG. 23A, the piezoelectric layers 20*a* to 20*f* which have been formed in the shape corresponding to the opening shape of the ink chamber 16 respectively, and on which the electrode layers 19*a* to 19*f* have been formed respectively, are laminated on the piezoelectric layer 20*g* on which the electrode layers 19*g* and 19*i* have been formed. The electrode layers 19*a* to 19*g* and 19*i* are formed by using a screen process printing or the like. Also, the screen process printing can be used for laminating the piezoelectric layers 20*a* to 20*g*. Next, as shown in FIG. 23B, the laminated piezoelectric layers 20*a* to 20*g* are respectively bonded by using a vacuum press method or the like, and are sintered. Next, a process to polarize each of the piezoelectric layers 20*a* to 20*g* in the predetermined direction shown in FIG. 13 is performed.

Next, as shown in FIG. 23C, the cavity plate 5*a* on which the ink chambers 16 and the peripheral portions 24 have been formed is bonded to the piezoelectric layer 20*g*, and the holding member 5*b* is bonded onto the top surface of the electrode layers 19*a*. Thus, the inkjet head 5 is completed.

According to the aforementioned manufacturing method, it is possible to manufacture the inkjet head 52 easily and accurately.

(XVII) Manufacturing Method for Inkjet Head of Seventh Embodiment

Figure 24A:
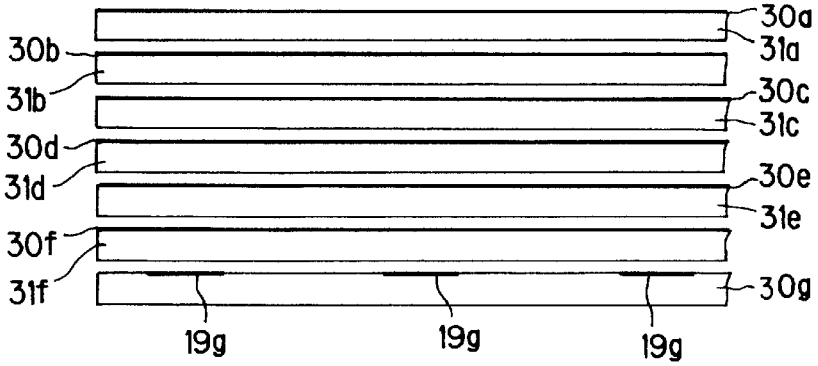
FIGS. 24A to 24C are sectional views showing a manufacturing method of the inkjet head of the seventh embodiment.
Figure 24B:
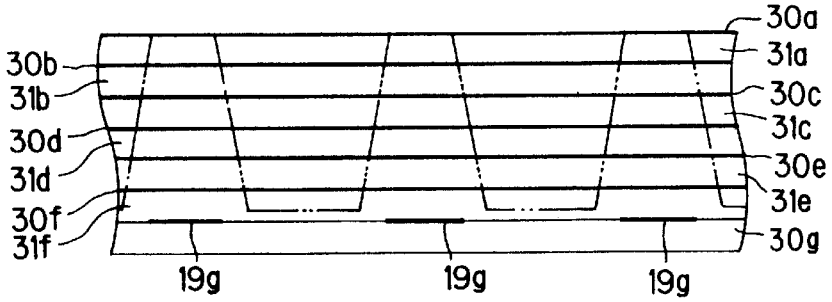
Figure 24C:
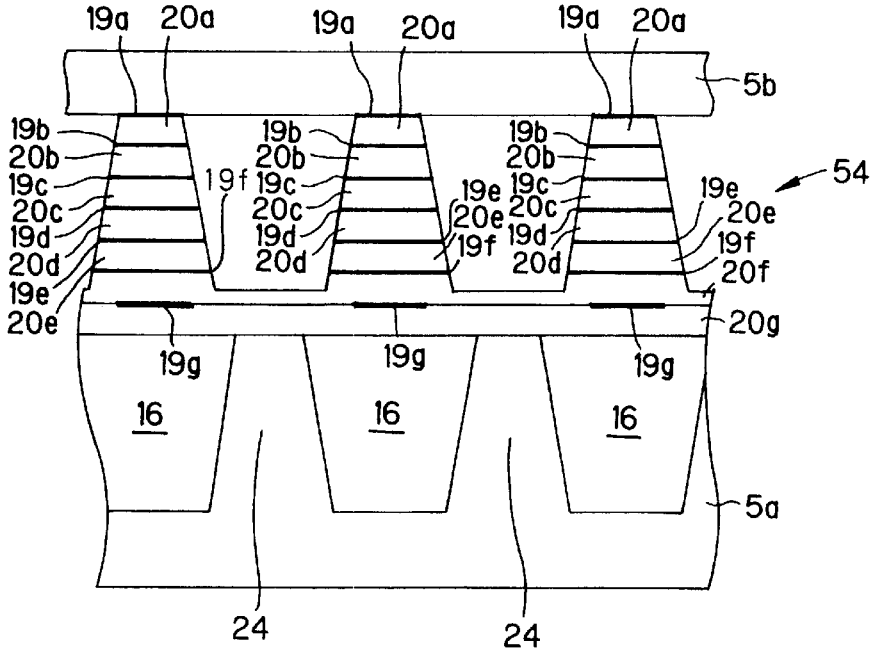

Referring to FIGS. 24A to 24C, a manufacturing method for the inkjet head 54 of the seventh embodiment is explained.

First, as shown in FIG. 24A, the sheet shaped piezoelectric element 30*g* is prepared. On the upside of the sheet shaped piezoelectric element 30*g*, the electrode layers 19*g* have been formed by a screen process printing or the like. The electrode layers 19*g* are located at the positions corresponding to the ink chambers 16, and extend perpendicular to the surface of FIG. 24A. Next, sheet shaped piezoelectric elements 31*a* to 31*f* on which electrode membranes 30*a* to 30*f* have been respectively formed by a screen process printing or the like are laminated on the sheet shaped piezoelectric element 30*g*. These laminated sheet shaped piezoelectric element 30*a* to 30*g* are respectively bonded by a vacuum press method or the like, and sintered.

Next, resist is applied onto the electrode membrane 30*a* at the parts corresponding to the electrode layer 19*a* to form a mask pattern. Next, an etching process is performed to remove unnecessary parts from the laminated piezoelectric elements 31*a* to 31*g*. Thus, as shown in FIG. 24B, the part shown by the chain double-dashed line remains, and the electrode layers 19*a* to 19*f* and the piezoelectric layers 20*a* to 20*g* are formed.

Next, as shown in FIG. 24C, the cavity plate 5*a* on which the ink chambers 16 and the peripheral portions 24 have been formed is bonded to the piezoelectric layer 20*g*, and the holding member 5*b* is bonded onto the top surface of the electrode layers 19*a*. Thus, the inkjet head 54 is completed.

According to the aforementioned manufacturing method, it is possible to manufacture the inkjet head 54 easily and accurately.

(XVIII) Manufacturing Method for Inkjet Head of Eighth Embodiment

Figure 25A:
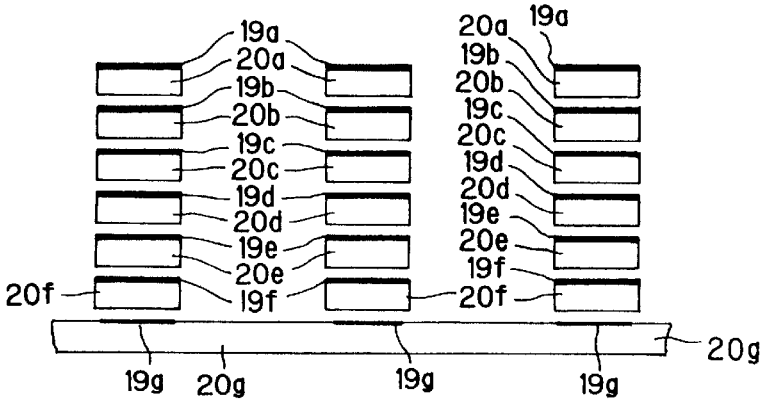
FIGS. 25A to 25C are sectional views showing a manufacturing method of the inkjet head of the eighth embodiment.
Figure 25B:
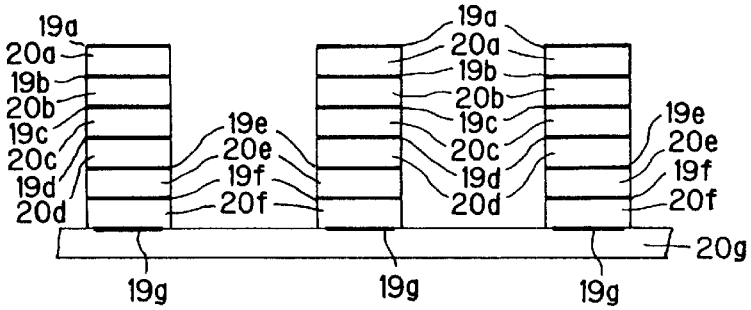
Figure 25C:
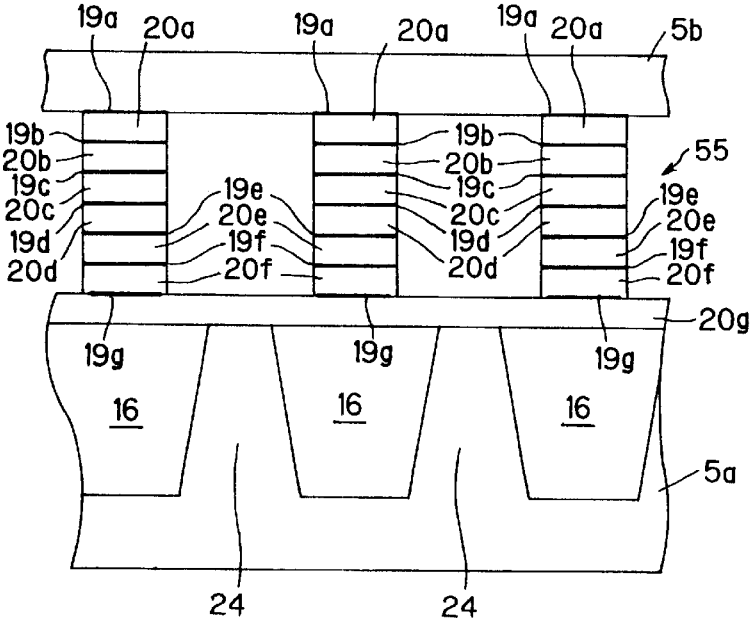

Referring to FIGS. 25A to 25C, a manufacturing method for the inkjet head 55 of the eighth embodiment is explained.

First, as shown in FIG. 25A, the piezoelectric layers 20*a* to 20*f* which have been formed in the shape corresponding to the opening shape of the ink chamber 16 respectively, and on which the electrode layers 19*a* to 19*f* have been formed respectively, are laminated on the piezoelectric layer 20*g* on which the electrode layers 19*g* have been formed. The electrode layers 19*a* to 19*g* can be formed by using a screen process printing or the like. Also, the screen process printing can be used for laminating the piezoelectric layers 20*a* to 20*g*. Next, as shown in FIG. 25B, the laminated piezoelectric layers 20*a* to 20*g* are respectively bonded by a vacuum press method or the like, and are sintered. Next, a process to polarize each of the piezoelectric layers 20*a* to 20*g* in the predetermined direction shown in FIG. 16 is performed.

Next, as shown in FIG. 25C, the cavity plate 5*a* on which the ink chambers 16 and the peripheral portions 24 have been formed is bonded to the piezoelectric layer 20*g*, and the holding member 5*b* is bonded onto the top surface of the electrode layers 19*a*. Thus, the inkjet head 55 is completed.

According to the aforementioned manufacturing method, it is possible to manufacture the inkjet head 55 easily and accurately.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A piezoelectric device for applying pressure to ink within a plurality of ink chambers formed in an inkjet head to control ejection of the ink, the piezoelectric device being mounted on a plate body of the inkjet head on which the plurality of ink chambers and a plurality of peripheral portions are alternately arranged, the piezoelectric device comprising:

a plurality of piezoelectric members located at positions corresponding to the ink chambers respectively, each of the piezoelectric members comprising a plurality of piezoelectric layers and a plurality of electrode layers, the piezoelectric layers and the electrode layers being alternately laminated, each of the piezoelectric layers being polarized in a direction of its thickness;

wherein a first group of piezoelectric layers in the plurality of piezoelectric layers are polarized such that respective polarization directions of the first group of piezoelectric layers are reversed for each group of piezoelectric layers;

the first group of piezoelectric layers is deformed in an expansion mode by an electric field whose direction is parallel to the polarization directions of the piezoelectric layers, the electric field being applied to the plurality of piezoelectric layers; and the entire plurality of piezoelectric layers are deformed in a combination of at least two different modes including the expansion mode by another electric field being further applied to at least one piezoelectric layer other than the first group of piezoelectric layers.

2. A piezoelectric device for applying pressure to ink within a plurality of ink chambers formed in an inkjet head to control ejection of the ink, the piezoelectric device being mounted on a plate body of the inkjet head on which the plurality of ink chambers and a plurality of peripheral portions are alternately arranged, the piezoelectric device comprising:

a base piezoelectric layer whose underside is fixed onto the plate body, and covering over the ink chambers and the peripheral portions, the base piezoelectric layer being polarized in a direction of its thickness;

an electric field applying device for applying an electric field to the base piezoelectric layer, a direction of the electric field intersecting a polarization direction of the base piezoelectric layer; and a plurality of piezoelectric members arranged on an upside of the base piezoelectric layer, and located at positions corresponding to the ink chambers respectively, wherein each of the piezoelectric members comprise a plurality of piezoelectric layers and a plurality of electrode layers, the piezoelectric layers and the electrode layers being alternately laminated, each of the piezoelectric layers being polarized in a direction of its thickness such that respective polarization directions of the piezoelectric layers are reversed for each of the piezoelectric layers.

3. The piezoelectric device according to claim 2, wherein the electric field applying device comprises a plurality of first electrodes and a plurality of second electrodes mounted on the upside of the base piezoelectric layer, the first electrodes being located at positions corresponding to the ink chambers respectively, and the second electrodes being located at positions corresponding to the peripheral portions respectively.

4. A piezoelectric device according to claim 2, wherein the electric field applying device comprises a plurality of first electrodes and a plurality of second electrodes mounted on the underside of the base piezoelectric layer, the first electrodes being located at positions corresponding to the ink chambers respectively, and the second electrodes being located at positions corresponding to the peripheral portions respectively.

5. A piezoelectric device for applying pressure to ink within a plurality of ink chambers formed in an inkjet head to control ejection of the ink, the piezoelectric device being mounted on a plate body of the inkjet head on which the plurality of ink chambers and a plurality of peripheral portions are alternately arranged, the piezoelectric device comprising:

an elastic layer whose underside is fixed onto the plate body, and covering over the ink chambers and the peripheral portions, the elastic layer being made of an elastic material;

a base piezoelectric layer laminated on an upside of the elastic layer, the base piezoelectric layer being polarized in a direction of its thickness;

a first electric field applying device for applying a first electric field to the base piezoelectric layer, a direction of the first electric field being parallel to a polarization direction of the base piezoelectric layer;

a plurality of piezoelectric members arranged on an upside of the base piezoelectric layer, and located at positions corresponding to the ink chambers respectively, wherein each of the piezoelectric members comprise a plurality of piezoelectric layers and a plurality of electrode layers, the piezoelectric layers and the electrode layers being alternately laminated, each of the piezoelectric layers being polarized in a direction of its thickness such that respective polarization directions of the piezoelectric layers are reversed for each of the piezoelectric layers.

6. The piezoelectric device according to claim 5, wherein the first electric field applying device comprises a plurality of first electrodes mounted between the elastic layer and the base piezoelectric layer.

7. The piezoelectric device according to claim 6, further comprising:

a second electric field applying device for applying a second electric field to the base piezoelectric layer, a direction of the second electric field intersecting the polarization direction of the base piezoelectric layer.

8. The piezoelectric device according to claim 7, wherein the second electric field applying device comprises a plurality of first electrodes and a plurality of second electrodes mounted between the elastic layer and the base piezoelectric layer, the first electrodes being located at positions corresponding to the ink chambers respectively, and the second electrodes being located at positions corresponding to the peripheral portions respectively.

9. A piezoelectric device for applying pressure to ink within a plurality of ink chambers formed in an inkjet head to control ejection of the ink, the piezoelectric device being mounted on a plate body of the inkjet head on which the plurality of ink chambers and a plurality of peripheral portions are alternately arranged, the piezoelectric device comprising:

a first base piezoelectric layer whose underside is fixed onto the plate body, and covering over the ink chambers and the peripheral portions, the first base piezoelectric layer being polarized in a direction of its thickness;

a second base piezoelectric layer laminated on an upside of the first base piezoelectric layer, the second base piezoelectric layer being polarized in a direction of its thickness;

a first electric field applying device for applying a first electric field to each of the first base piezoelectric layer and the second base piezoelectric layer, a direction of the first electric field being parallel to a polarization direction of each of the first base piezoelectric layer and the second base piezoelectric layer; and a plurality of piezoelectric members arranged on an upside of the second base piezoelectric layer, and located at positions corresponding to the ink chambers respectively, wherein each of the piezoelectric members comprise a plurality of piezoelectric layers and a plurality of electrode layers, the piezoelectric layers and the electrode layers being alternately laminated, each of the piezoelectric layers being polarized in a direction of its thickness such that respective polarization directions of the piezoelectric layers are reversed for each of the piezoelectric layers.

10. The piezoelectric device according to claim 9, wherein the first electric field applying device comprises:

a plurality of first electrodes mounted between the first base piezoelectric layer and the second base piezoelectric layer, and located at positions corresponding to the ink chambers respectively; and a second electrode mounted on the underside of the first base piezoelectric layer, and spreads over the underside of the first base piezoelectric layer.

11. The piezoelectric device according to claim 9, wherein the first electric field applying device comprises:

a first electrode mounted between the first base piezoelectric layer and the second base piezoelectric layer, and spreads between the first base piezoelectric layer and the second base piezoelectric layer; and a plurality of second electrodes mounted on the underside of the first base piezoelectric layer, and located at positions corresponding to the ink chambers respectively.

12. The piezoelectric device according to claim 9, further comprising:

a second electric field applying device for applying a second electric field to each of the first base piezoelectric layer and the second base piezoelectric layer, a direction of the second electric field intersecting the polarization direction of each of the first base piezoelectric layer and the second base piezoelectric layer.

13. A piezoelectric device according to claim 12, wherein the second electric field applying device comprises a plurality of first electrodes and a plurality of second electrodes mounted between the first base piezoelectric layer and the second base piezoelectric layer, the first electrodes being located at positions corresponding to the ink chambers respectively, the second electrodes being located at positions corresponding to the peripheral portions respectively.

14. A piezoelectric device for applying pressure to ink within a plurality of ink chambers formed in an inkjet head to control ejection of the ink, the piezoelectric device being mounted on a plate body of the inkjet head on which the plurality of ink chambers and a plurality of peripheral portions are alternately arranged, the piezoelectric device comprising:

a first base piezoelectric layer whose underside is fixed onto the plate body, and covering over the ink chambers and the peripheral portions, the first base piezoelectric layer being polarized in a direction of its thickness;

a second base piezoelectric layer laminated on an upside of the first base piezoelectric layer, the second base piezoelectric layer being polarized in a direction of its thickness;

a first electric field applying device for applying a first electric field to each of the first base piezoelectric layer and the second base piezoelectric layer, a direction of the first electric field intersecting a polarization direction of each of the first base piezoelectric layer and the second base piezoelectric layer;

a second electric field applying device for applying a second electric field to the second base piezoelectric layer, a direction of the second electric field being parallel to a polarization direction of the second base piezoelectric layer; and a plurality of piezoelectric members arranged on an upside of the second base piezoelectric layer, and located at positions corresponding to the ink chambers respectively, wherein each of the piezoelectric members comprise a plurality of piezoelectric layers and a plurality of electrode layers, the piezoelectric layers and the electrode layers being alternately laminated, each of the piezoelectric layers being polarized in a direction of its thickness such that respective polarization directions of the piezoelectric layers are reversed for each of the piezoelectric layers.

15. An ink jet head, comprising:

a plate body on which a plurality of ink chambers and a plurality of peripheral portions are alternately arranged, and through which a plurality of ink ejection holes are formed for each of the ink chambers;

a piezoelectric device mounted on an upside of the plate body, for applying pressure to ink within the plurality of ink chambers to control ejection of the ink; and a holding member mounted on an upside of the piezoelectric device, for holding the piezoelectric device between the plate body and the holding member, the piezoelectric device comprising:

a plurality of piezoelectric members located at positions corresponding to the ink chambers respectively, each of the piezoelectric members comprising a plurality of piezoelectric layers and a plurality of electrode layers, the piezoelectric layers and the electrode layers being alternately laminated, each of the piezoelectric layers being polarized in a direction of its thickness, wherein a first group of piezoelectric layers in the plurality of piezoelectric layers are polarized such that respective polarization directions of the first group of piezoelectric layers are reversed for each group of piezoelectric layers, the first group of piezoelectric layers are deformed in an expansion mode by an electric field whose direction is parallel to the polarization directions of the piezoelectric layers, the electric field being applied to the plurality of piezoelectric layers; and wherein the entire plurality of piezoelectric layers are deformed in a combination of at least two different modes including the expansion mode by another electric field being further applied to at least one piezoelectric layer other than the first group of piezoelectric layers.

16. An ink jet head, comprising:

a plate body on which a plurality of ink chambers and a plurality of peripheral portions are alternately arranged, and through which a plurality of ink ejection holes are formed for each of the ink chambers;

a piezoelectric device mounted on an upside of the plate body, for applying pressure to ink within the plurality of ink chambers to control ejection of the ink; and a holding member mounted on an upside of the piezoelectric device, for holding the piezoelectric device between the plate body and the holding member;

the piezoelectric device, comprising:

a base piezoelectric layer whose underside is fixed onto the plate body, and covering over the ink chambers and the peripheral portions, the base piezoelectric layer being polarized in a direction of its thickness;

an electric field applying device for applying an electric field to the piezoelectric layer, a direction of the electric field intersecting a polarization direction of the base piezoelectric layer; and a plurality of piezoelectric members arranged on an upside of the base piezoelectric layer, and located at positions corresponding to the ink chambers respectively, wherein each of the piezoelectric members comprise a plurality of piezoelectric layers and a plurality of electrode layers, the piezoelectric layers and the electrode layers being alternately laminated, each of the piezoelectric layers being polarized in a direction of its thickness such that respective polarization directions of the piezoelectric layers are reversed for each of the piezoelectric layers.

17. An ink jet head, comprising:

a plate body on which a plurality of ink chambers and a plurality of peripheral portions are alternately arranged, and through which a plurality of ink ejection holes are formed for each of the ink chambers;

a piezoelectric device mounted on an upside of the plate body, for applying pressure to ink within the plurality of ink chambers to control ejection of the ink; and a holding member mounted on an upside of the piezoelectric device, for holding the piezoelectric device between the plate body and the holding member;

the piezoelectric device, comprising:

an elastic layer whose underside is fixed onto the plate body, and covering over the ink chambers and the peripheral portions, the elastic layer being made of an elastic material;

a base piezoelectric layer laminated on an upside of the elastic layer, the base piezoelectric layer being polarized in a direction of its thickness;

an electric field applying device for applying an electric field to the base piezoelectric layer, a direction of the electric field being parallel to a polarization direction of the base piezoelectric layer; and a plurality of piezoelectric members arranged on an upside of the base piezoelectric layer, and located at positions corresponding to the ink chambers respectively, wherein each of the piezoelectric members comprise a plurality of piezoelectric layers and a plurality of electrode layers, the piezoelectric layers and the electrode layers being alternately laminated, each of the piezoelectric layers being polarized in a direction of its thickness such that respective polarization directions of the piezoelectric layers are reversed for each of the piezoelectric layers.

18. An ink jet head, comprising:

a plate body on which a plurality of ink chambers and a plurality of peripheral portions are alternately arranged, and through which a plurality of ink ejection holes are formed for each of the ink chambers;

a piezoelectric device mounted on an upside of the plate body, for applying pressure to ink within the plurality of ink chambers to control ejection of the ink; and a holding member mounted on an upside of the piezoelectric device, for holding the piezoelectric device between the plate body and the holding member;

the piezoelectric device, comprising:

a first base piezoelectric layer whose underside is fixed onto the plate body, and covering over the ink chambers and the peripheral portions, the first base piezoelectric layer being polarized in a direction of its thickness;

a second base piezoelectric layer laminated on an upside of the first base piezoelectric layer, the second base piezoelectric layer being polarized in a direction of its thickness;

an electric field applying device for applying an electric field to each of the first base piezoelectric layer and the second base piezoelectric layer, a direction of the electric field being parallel to a polarization direction of each of the first base piezoelectric layer and the second base piezoelectric layer; and a plurality of piezoelectric members arranged on an upside of the second base piezoelectric layer, and located at positions corresponding to the ink chambers respectively, wherein each of the piezoelectric members comprise a plurality of piezoelectric layers and a plurality of electrode layers, the piezoelectric layers and the electrode layers being alternately laminated, each of the piezoelectric layers being polarized in a direction of its thickness such that respective polarization directions of the piezoelectric layers are reversed for each of the piezoelectric layers.

19. An ink jet head, comprising:

a plate body on which a plurality of ink chambers and a plurality of peripheral portions are alternately arranged, and through which a plurality of ink ejection holes are formed for each of the ink chambers;

a piezoelectric device mounted on an upside of the plate body, for applying pressure to ink within the plurality of ink chambers to control ejection of the ink; and a holding member mounted on an upside of the piezoelectric device, for holding the piezoelectric device between the plate body and the holding member;

the piezoelectric device, comprising:

a first base piezoelectric layer whose underside is fixed onto the plate body, and covering over the ink chambers and the peripheral portions, the first base piezoelectric layer being polarized in a direction of its thickness;

a second base piezoelectric layer laminated on an upside of the first base piezoelectric layer, the second base piezoelectric layer being polarized in a direction of its thickness;

a first electric field applying device for applying a first electric field to each of the first base piezoelectric layer and the second base piezoelectric layer, a direction of the first electric field intersecting a polarization direction of each of the first base piezoelectric layer and the second base piezoelectric layer;

a second electric field applying device for applying a second electric field to the second base piezoelectric layer, a direction of the second electric field being parallel to a polarization direction of the second base piezoelectric layer; and a plurality of piezoelectric members arranged on an upside of the second base piezoelectric layer, and located at positions corresponding to the ink chambers respectively, wherein each of the piezoelectric members comprise a plurality of piezoelectric layers and a plurality of electrode layers, the piezoelectric layers and the electrode layers being alternately laminated, each of the piezoelectric layers being polarized in a direction of its thickness such that respective polarization directions of the piezoelectric layers are reversed for each of the piezoelectric layers.

* * * * *